US009140122B2

(12) United States Patent
Cho et al.

(10) Patent No.: US 9,140,122 B2
(45) Date of Patent: Sep. 22, 2015

(54) EXCAVATION SYSTEM USING A WATER JET, AND EXCAVATION METHOD USING THE SAME

(75) Inventors: Gye-Chun Cho, Daejeon (KR); Tae-Min Oh, Busan (KR)

(73) Assignee: KAIST (KOREA ADVANCED INSTITUTE OF SCIENCE AND TECHNOLOGY), Daejeon (KR)

( * ) Notice: Subject to any disclaimer, the term of this patent is extended or adjusted under 35 U.S.C. 154(b) by 77 days.

(21) Appl. No.: 13/876,782

(22) PCT Filed: Oct. 4, 2011

(86) PCT No.: PCT/KR2011/007322

§ 371 (c)(1), (2), (4) Date: Mar. 28, 2013

(87) PCT Pub. No.: WO2012/044138

PCT Pub. Date: Apr. 5, 2012

(65) Prior Publication Data

US 2013/0200680 A1 Aug. 8, 2013

(30) Foreign Application Priority Data

| | | |
|---|---|---|
| Oct. 1, 2010 | (KR) | 10-2010-0095879 |
| Oct. 19, 2010 | (KR) | 10-2010-0102134 |
| Oct. 19, 2010 | (KR) | 10-2010-0102135 |
| Mar. 31, 2011 | (KR) | 10-2011-0029250 |

(51) Int. Cl.
*E21B 7/02* (2006.01)
*E21D 9/10* (2006.01)
(Continued)

(52) U.S. Cl.
CPC ..... *E21D 9/1066* (2013.01); *E21C 25/60* (2013.01); *E21D 9/003* (2013.01); *E21D 9/004* (2013.01); *E21D 9/006* (2013.01); *E21D 9/1053* (2013.01)

(58) Field of Classification Search
CPC ..... E21C 25/60; E21C 35/24
See application file for complete search history.

(56) References Cited

U.S. PATENT DOCUMENTS

| | | | | |
|---|---|---|---|---|
| 3,813,126 | A * | 5/1974 | Rogne et al. | 299/33 |
| 4,193,634 | A * | 3/1980 | Nakamura et al. | 299/17 |

(Continued)

FOREIGN PATENT DOCUMENTS

| | | |
|---|---|---|
| JP | 1992-371695 | 12/1992 |
| JP | 1994-170271 | 6/1994 |

(Continued)

OTHER PUBLICATIONS

Office Action issued by the Japanese Patent Office on Jul. 1, 2014.

(Continued)

*Primary Examiner* — John Kreck
(74) *Attorney, Agent, or Firm* — IP & T Group LLP

(57) ABSTRACT

A tunnel excavation technique using a water jet. A water jet system includes a moving unit movable back and forth with respect to an area to be blasted for tunnel excavation, an articulated robot arm mounted on the moving unit, a water jet nozzle which ejects high-pressure water and an abrasive toward an area to be excavated, and a control unit which controls the moving unit, the articulated robot arm and the water jet nozzle. A free face having a predetermined depth is formed of the area to be excavated in the direction in which the tunnel is to be excavated using the water jet system. Since the blasting is performed after the free face is formed, blast vibration can be effectively restricted.

10 Claims, 34 Drawing Sheets

(51) Int. Cl.
*E21C 25/60* (2006.01)
*E21D 9/00* (2006.01)

(56) References Cited

U.S. PATENT DOCUMENTS

| | | | | |
|---|---|---|---|---|
| 4,960,176 | A * | 10/1990 | Loegel et al. | 175/424 |
| 5,411,432 | A * | 5/1995 | Wyatt et al. | 451/92 |
| 5,765,924 | A * | 6/1998 | Liesveld | 299/15 |
| 5,851,580 | A * | 12/1998 | Amberg et al. | 427/8 |
| 8,086,360 | B2 * | 12/2011 | Hilmersson | 700/302 |
| 2005/0077775 | A1 * | 4/2005 | Nakakuro | 299/17 |

FOREIGN PATENT DOCUMENTS

| | | |
|---|---|---|
| JP | 1998-096627 | 4/1998 |
| JP | 2001-003677 | 1/2001 |
| JP | 2004-285789 | 10/2004 |
| KR | 1019950019034 | 7/1995 |
| KR | 100827428 | 5/2008 |
| KR | 1020100055639 | 5/2010 |

OTHER PUBLICATIONS

Notification of the First Office Action issued by the State Intellectual Property Office of the People's Republic of China on May 13, 2014.

Notification of the Second Office Action issued by the State Intellectual Property Office of the People's Republic of China on Dec. 2, 2014.

Office Action issued by the Korean Intellectual Property Office on Oct. 16, 2013.

Office Action issued by the Korean Intellectual Property Office on Mar. 19, 2014.

* cited by examiner (a)

(b)

TYPICAL TUNNEL (a) (b) (c)

MAXIMUM VERTICAL DISPLACEMENT CONTOUR

TYPICAL TUNNEL (a) (b) (c)

PEAK PARTICLE VELOCITY IN THE VERTICAL DIRECTION

HISTORY OF VERTICAL PARTICLE VELOCITIES MEASURED AT 2 M ABOVE THE CONTOUR HOLE

EXCAVATION SYSTEM USING A WATER JET, AND EXCAVATION METHOD USING THE SAME

This application is a national stage application of PCT/KR2011/007322 filed on Oct. 4, 2011, which claims priority of Korean patent applications number 10-2010-0095879, 10-2010-0102134, 10-2010-0102135, and 10-2011-0029250 filed on Oct. 1, 2010, Oct. 19, 2010, Oct. 19, 2010, and Mar. 31, 2011, respectively. The disclosure of each of the foregoing applications is incorporated herein by reference in its entirety.

TECHNICAL FIELD

The present invention relates, in general, to a tunnel excavation technology based on explosion blasting, and more particularly, to a technology for reducing the propagation of impact or vibration caused by blasting which occurs during the tunnel excavation process. Even more particularly, the present invention relates to an excavation system which forms a free surface, or a series of spaces, around a tunnel using a water jet, so that the blast vibration is not propagated to the ground surface, and an excavation method using the same.

BACKGROUND ART

A blasting process using explosives is frequently carried out for construction and engineering operations, in particular, underground tunnel excavation. Although the blasting process has the merit of being capable of efficiently removing a rock base or other obstacles using the explosive power of the explosives, vibration and noise that are unavoidably produced upon blasting are propagated to the ground surface, having an adverse effect on buildings and a variety of other structures. In addition, although impact waves propagated from the source of explosion during the blasting process are significantly reduced depending on the distance, some of the energy generated at that time causes vibration (blast vibration) of the ground while being propagated in the form of elastic waves. When a building or subway facilities are present at a relatively close distance from the source of explosion, there is a possibility that a severe problem can be caused.

Technologies of the related art for reducing the above-described blast vibration are as follows. First, an excavation structure and method for blocking blast vibration using line drill holes disclosed in Korean Patent No. 0531985 proposed a technology of forming at least two rows of line drill holes around an area to be blasted in a rock base to be excavated such that the line drill holes of one row alternate with the line drill holes of the other row. In addition, a tunnel blasting method disclosed in Korean Patent No. 0599982 proposed a technology that uses large uncharged holes which are formed at a distance from the contour of a tunnel, crack guide holes which are disposed between the uncharged holes, and a plurality of expansion holes which are formed inward of the uncharged holes.

These preceding technologies share a commonality in that a plurality of holes which are formed in the direction in which the tunnel extends is used as a vibration reducing means. However, when a plurality of holes is formed, connecting areas are present between the holes. Blast vibration that is propagated through the connecting areas is not blocked. Therefore, the holes used in the preceding technologies are an imperfect vibration reducing means.

In addition, tunnel excavation methods of the related art leave a damage zone in an adjacent rock base portion due to blasting, thereby causing a danger of the tunnel collapsing (see FIG. 21). In particular, when blast force is excessive, a space exceeding a designed tunnel space is dug, thereby causing overbreak. In this case, a large amount of shotcrete must be poured into the vacant space, which is problematic. In contrast, when blast force is insufficient, underbreak occurs, and an additional operation using an excavator or a rock drill is required.

The tunnel excavation process of the related art involves forming a plurality of charge holes using a jumbo drill, charging the holes with explosives, and exploding the charged explosives. About one hundred charge holes are required for one blasting operation, and the operation of forming the charge holes is manually carried out by jumbo drill workers. Therefore, an improvement in the efficiency of the operation is required.

In general, in the tunnel excavation, a variety of front predictive methods of inspecting the status of a rock bed in the front area that is to be excavated in order to prevent the tunnel from collapsing or the like are being introduced. However, indirect inspection, such as the measurement of a resistance depending on the properties of the rock base, is carried out instead of substantial inspect. Therefore, these methods have low inspection reliability, and still have a danger in that the tunnel may collapse during excavation.

DISCLOSURE

Technical Problem

Accordingly, the present invention has been made keeping in mind the above problems occurring in the related art, and is intended to provide a water jet device and an excavation method which effectively reduces the propagation of impact, vibration or noise caused by blasting which occurs during a tunnel excavation process.

The invention is also intended to prevent underbreak or overbreak which would otherwise be produced by the blasting of the tunnel.

The invention is also intended to minimize a damage zone which is formed by the blasting, thereby improving the stability of the tunnel.

The invention is also intended to maximize the efficiency of an operation, so that the operation can be efficiently carried out.

The invention is also intended to enable an excavation point in the tunnel face to be substantially inspected.

Technical Solution

In order to overcome the foregoing technical objects, the present invention provides an excavation system using a water jet and an excavation method using the same.

The inventors of the invention considered the connecting areas between the holes, which are known as a problem with the related art, as an adverse faction that must be removed, and defined the formation of a free surface, or a continuous space, along the outer circumference of a tunnel as a best mode. A major technical solution for realizing the best mode is to introduce a water jet technology and an abrasive.

In an aspect of the invention, provided is a water jet system that includes a moving unit movable over an area that is to be blasted; an articulated robot arm disposed on the moving unit; a water jet nozzle mounted on a leading end of the robot arm; a supply unit which supplies high pressure water to the water jet nozzle; and a control unit which controls the moving unit, the robot arm and the water jet nozzle. It is preferable that the supply unit supply an abrasive along with high-pressure water.

According to an embodiment of the invention, the water jet nozzle may include a depth sensor part which measures a depth of the free surface that is crushed by the high-pressure water, and the control unit may control the robot am and the supply unit based on the depth that is crushed.

In addition, the water jet nozzle may include a width sensor part which measures a width of the free surface that is crushed by the high-pressure water, and the control unit may control the robot arm and the supply unit based on the width that is crushed.

The water jet system having the above-described, configuration forms a free surface having a predetermined depth around an area to be blasted in the direction in which the tunnel is to be excavated. After the free surface is formed, explosives the area to be excavated is charged with explosives and blasted.

Advantageous Effects

According to the invention, it is possible to effectively reduce the propagation of blast vibration using the free surface.

In addition, since blast overbreak is reduced, the cost of an additional reinforcing construction can be reduced.

Furthermore, no underbreak is produced, thereby requiring no additional operation, and the formation of a damage zone due to blasting is minimized, thereby enhancing the stability of the tunnel and improving the operation efficiency.

In addition, it is possible to substantially analyze the geological features of the tunnel face to be excavated, thereby ensuring the safety of tunnel construction.

MODE FOR INVENTION

Figure 1:
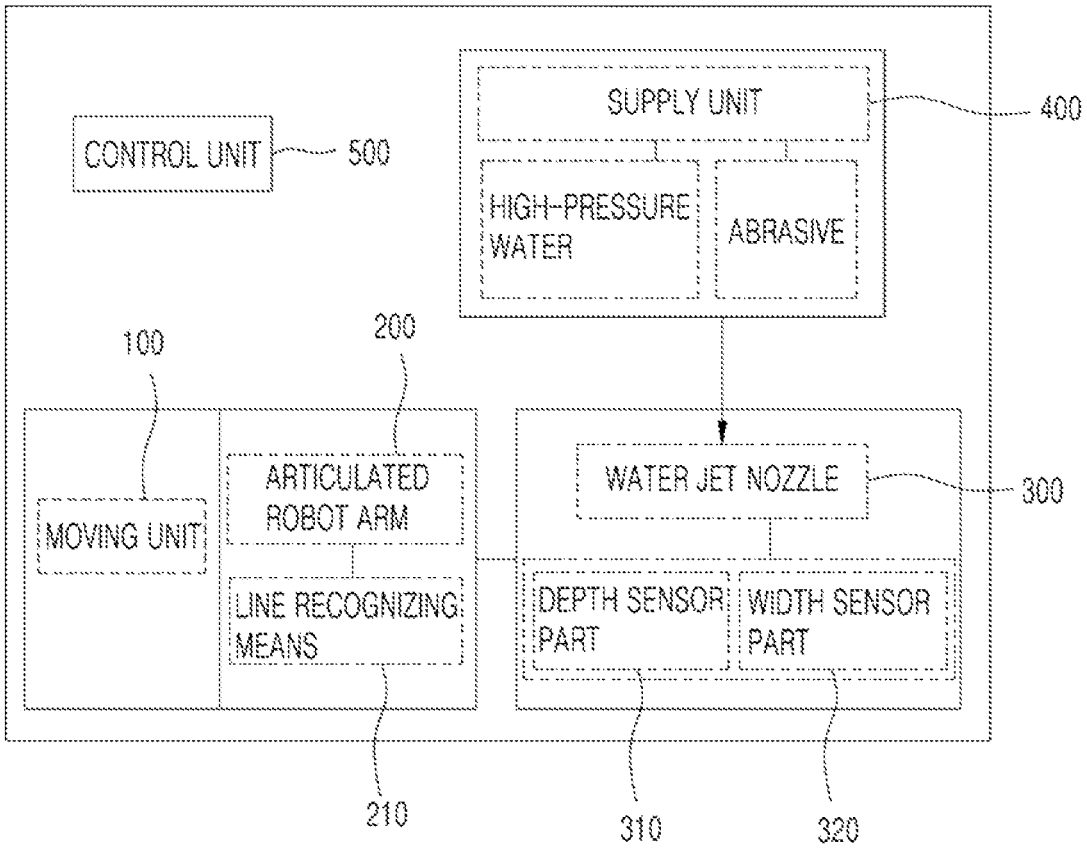
FIG. 1 is a configuration view of a tunnel excavating water jet system according to an embodiment of the invention.

In order to realize the foregoing object/ the present invention provides an excavation system that includes:

- a moving unit movable over an area that is to be blasted;
- an articulated robot arm disposed on the moving unit;
- a water jet nozzle mounted on a leading end of the robot arm;
- a supply unit which supplies high pressure wafer to the water jet nozzle; and
- a control unit which controls the moving unit, the robot arm and the water jet nozzle.

Hereinafter, exemplary embodiments of the invention will be described in detail with reference to the accompanying drawings.

First of all, the terminologies or words used in the description and the claims of the present invention should not be interpreted as being limited merely to common and dictionary meanings. On the contrary, they should be interpreted based on the meanings and concepts of the invention in compliance with the scope of the invention on the basis of the principle that the inventor(s) can appropriately define the terms in order to describe the invention in the best way.

Therefore, it should be understood that, since the following embodiments disclosed in the description and the constructions illustrated in the Drawings are provided by way of example and do not limit the scope of the present invention, a variety of equivalents and changes that can replace the following embodiments are possible at a time point when the present invention was applied.

Figure 21:
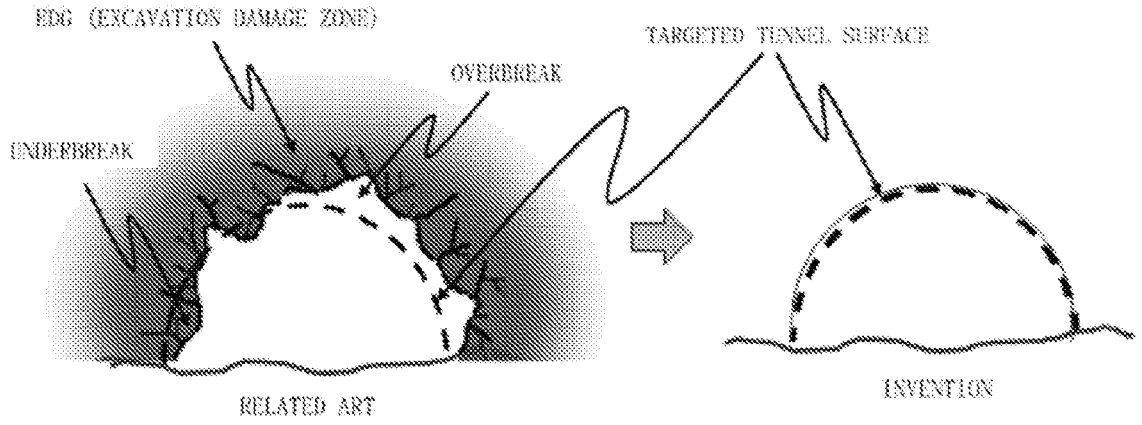
FIG. 21 is a conceptual view of tunnel excavation of the related art and according to the invention.
Figure 22A:
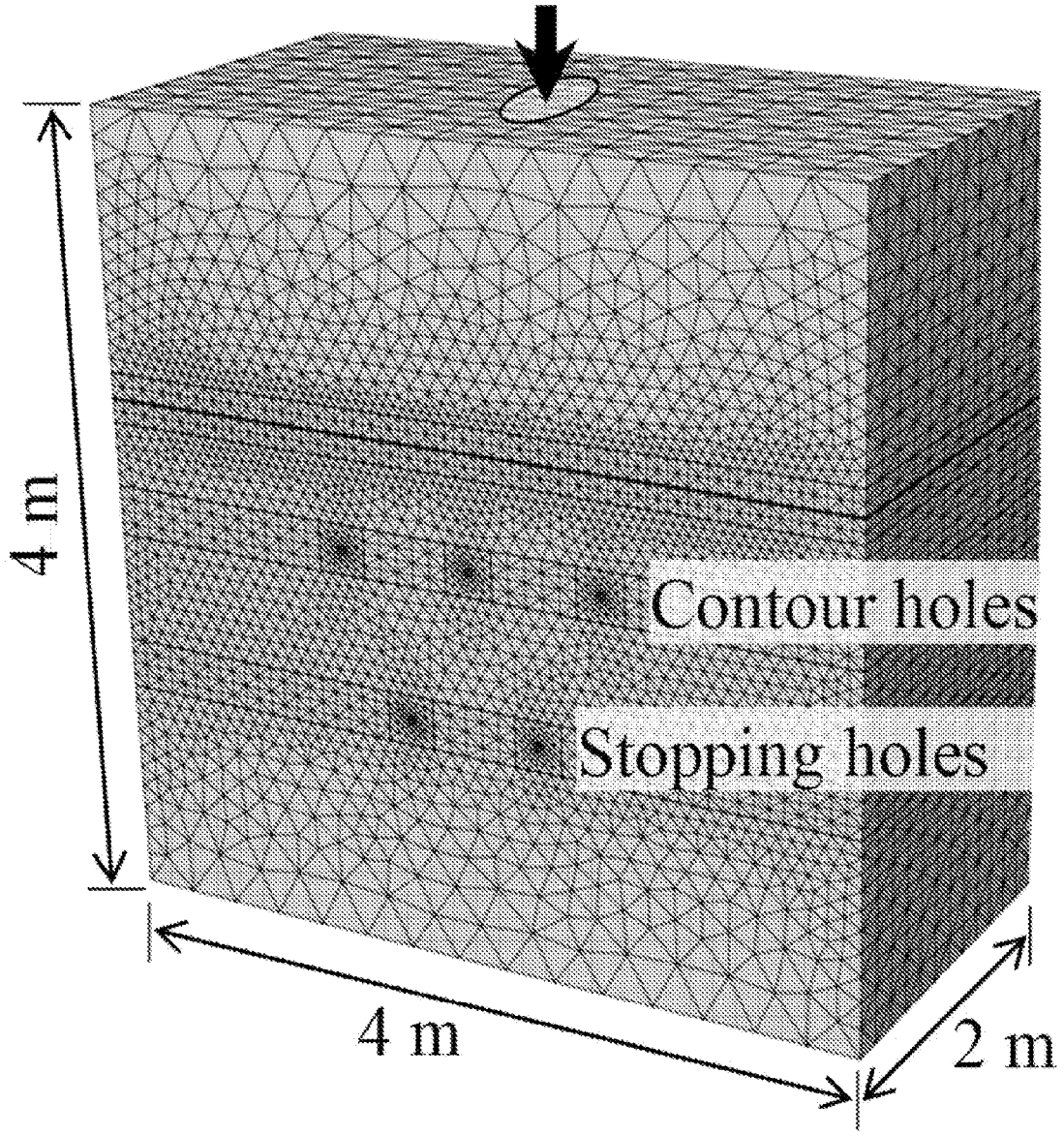
FIG. 22 is a view showing a model for numerical analysis in the vertical direction.
Figure 22B:
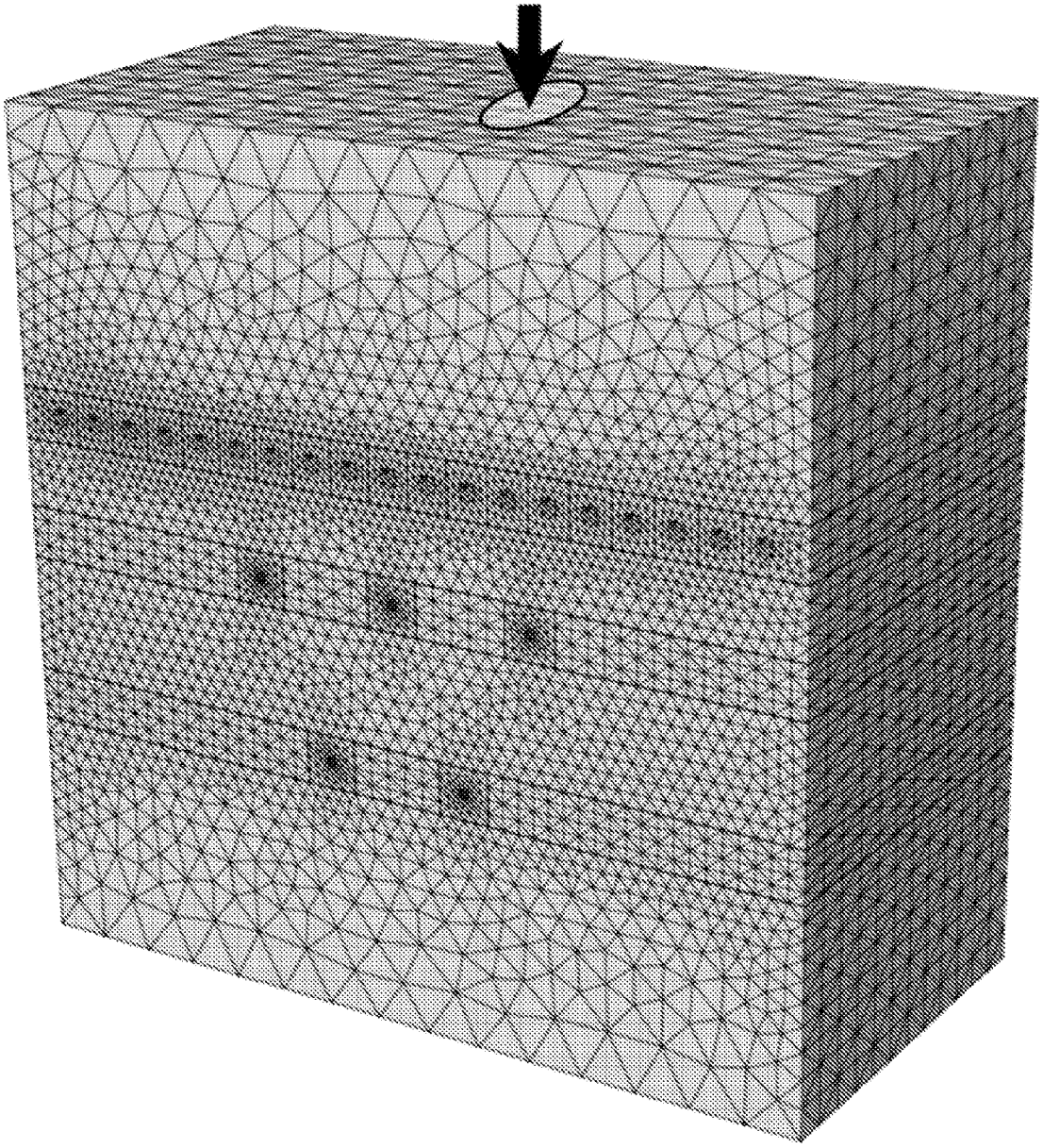
Figure 22C:
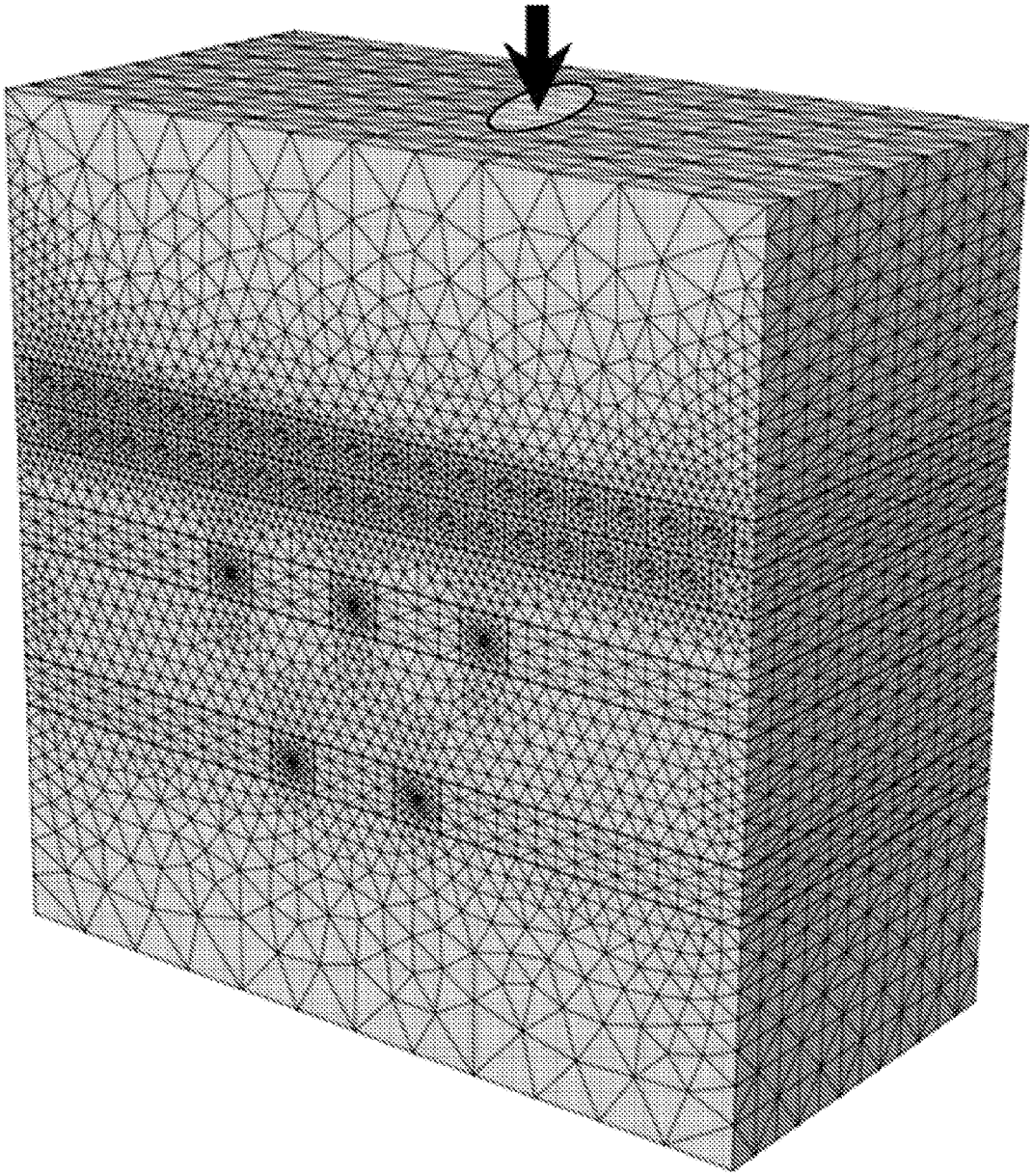
Figure 22D:
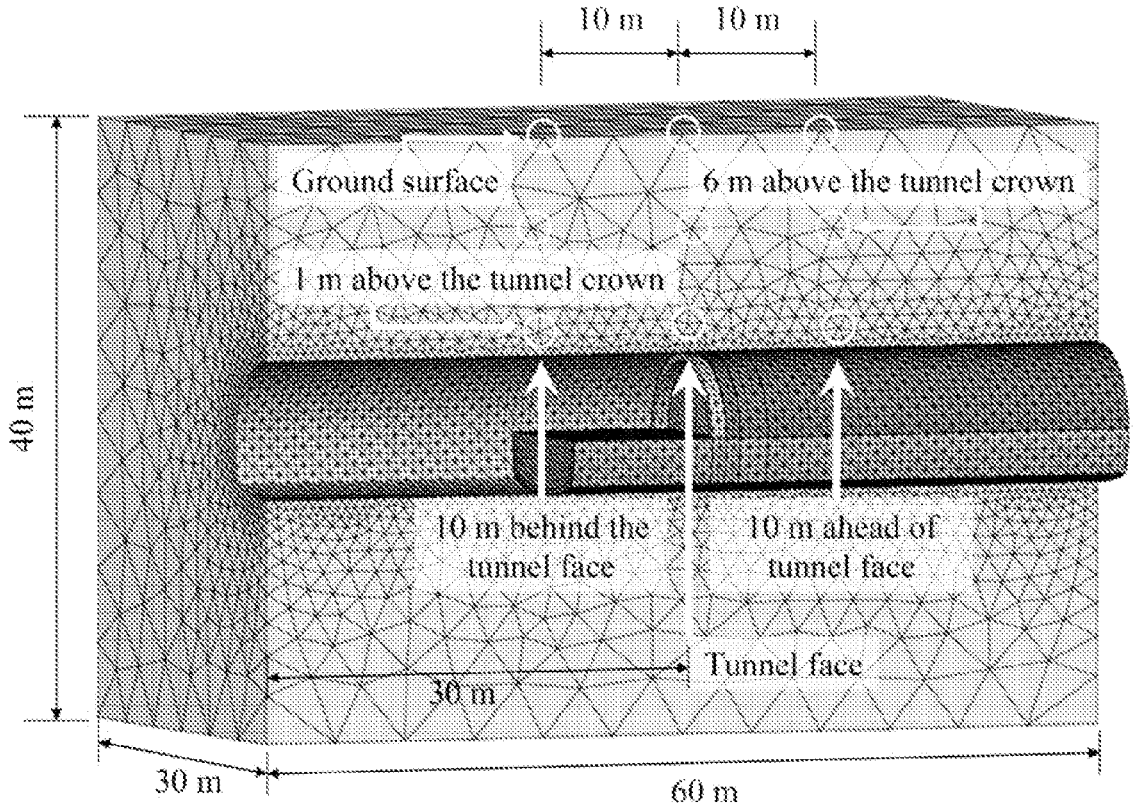

FIG. 1 is a configuration view of a tunnel excavating water jet system according to an embodiment of the invention. As shown in the figure, the excavation system using a water jet device 600 specifically relates to a technology for reducing the propagation of impact or vibration created by blasting that occurs in the process of tunnel excavation. More specifically, the invention relates to the excavation system using the water jet device 600 which prevents vibration from being propagated to the ground surface during blasting by forming a series of spaces, or a so-called free surface 20, along an outer surface (a planned surface of a tunnel: see FIG. 21) of a surface to be excavated 10 using the water jet device 600.

Figure 2:
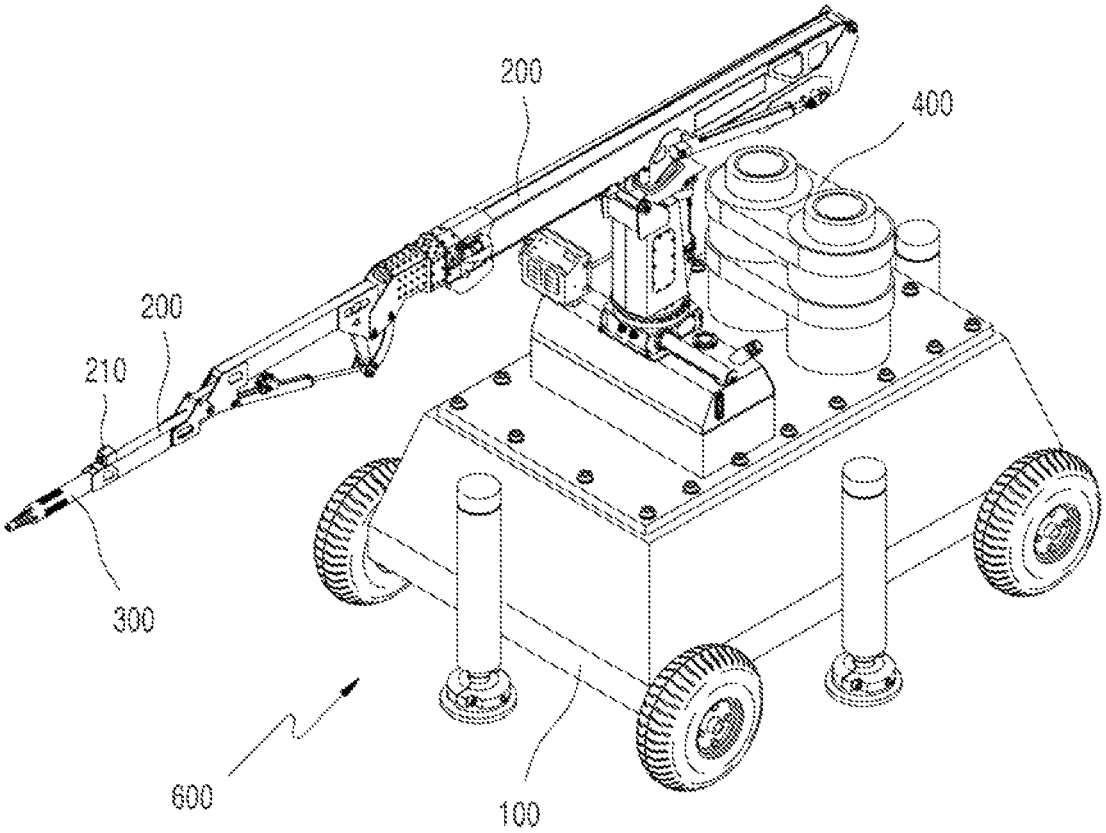
FIG. 2 is a view showing a tunnel excavating water jet device according to an embodiment of the invention.
Figure 3:
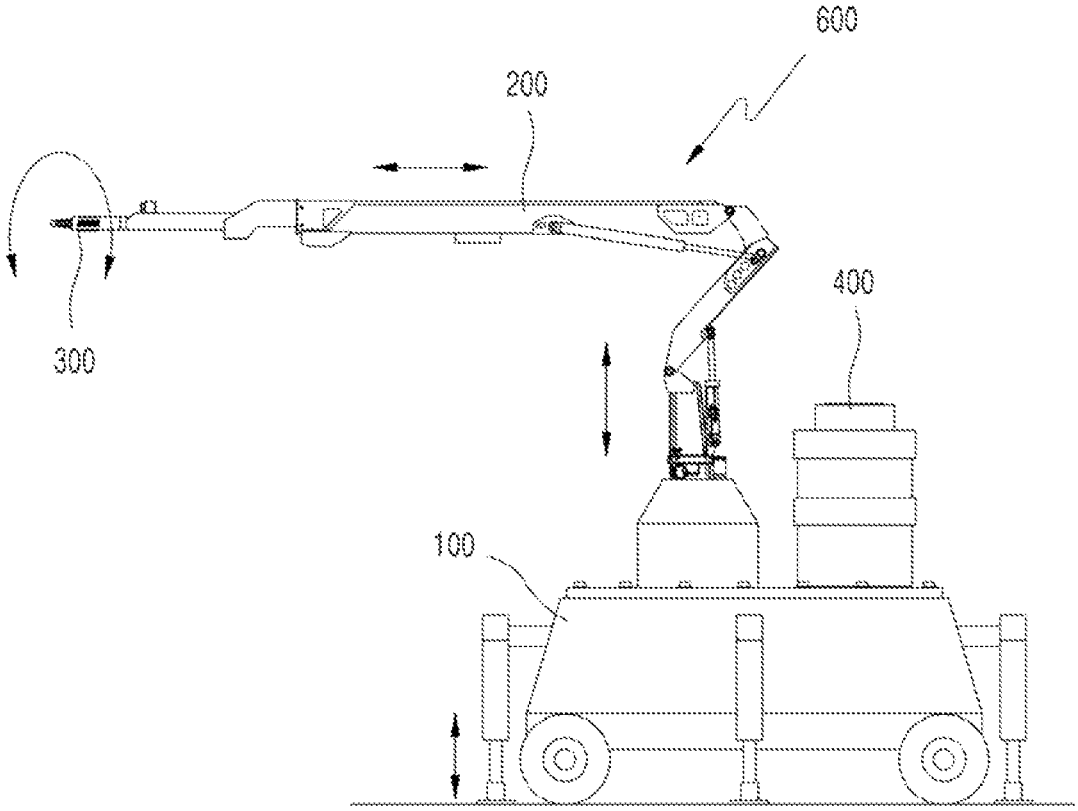
FIG. 3 is a view showing the movement of the tunnel excavating water jet according to an embodiment of the invention shown in FIG. 2.

Referring to FIG. 1 to FIG. 3, the water jet device 600 according to an embodiment of the invention generally includes a moving unit 100, an articulated robot arm 200, a water jet nozzle 300, a supply unit 400 and a control unit 500.

The moving unit 100 is a moving means which can move back and forth in the direction of excavation over an area to be excavated. Specifically, the moving unit 100 is a component which allows the water jet device 600 to freely move back and forth and to the left and to the right. The moving unit 100 can be implemented as including a plurality of wheels or a caterpillar, The moving unit 100 is disposed in front of the surface to be excavated 10, or the area to be blasted, and can move in the direction of tunnel blasting. An object to be moved is the articulated robot arm 200 which is provided with the water jet nozzle 300.

The articulated robot arm 200 has a multi-articulated structure mounted on the moving unit 100. The articulated robot arm 200 is mounted on the upper portion of the moving unit 100, and functions as a support for spatial movement of the water jet nozzle 300 which is mounted on the distal end thereof.

The joints of the articulated robot arm 200 are preferably configured as a hydraulic type since they are required to stand against a repulsive force or reaction of the water jet nozzle 300. For reference, although the water jet device 600 shown in FIG. 2 is illustrated as carrying out both the processes of crushing a base rock and cutting the base rock in the horizontal direction (hereinafter, referred to as 'horizontal process'), not only the horizontal processes but also vertical processes are also included according to the characteristics of the articulated robot arm 200 employed in the water jet device 600 of the invention. In addition, although one articulated robot arm 200 is illustrated in FIG. 2 and FIG. 3, a plurality of robot arms can be mounted and operated as required.

Figure 4:
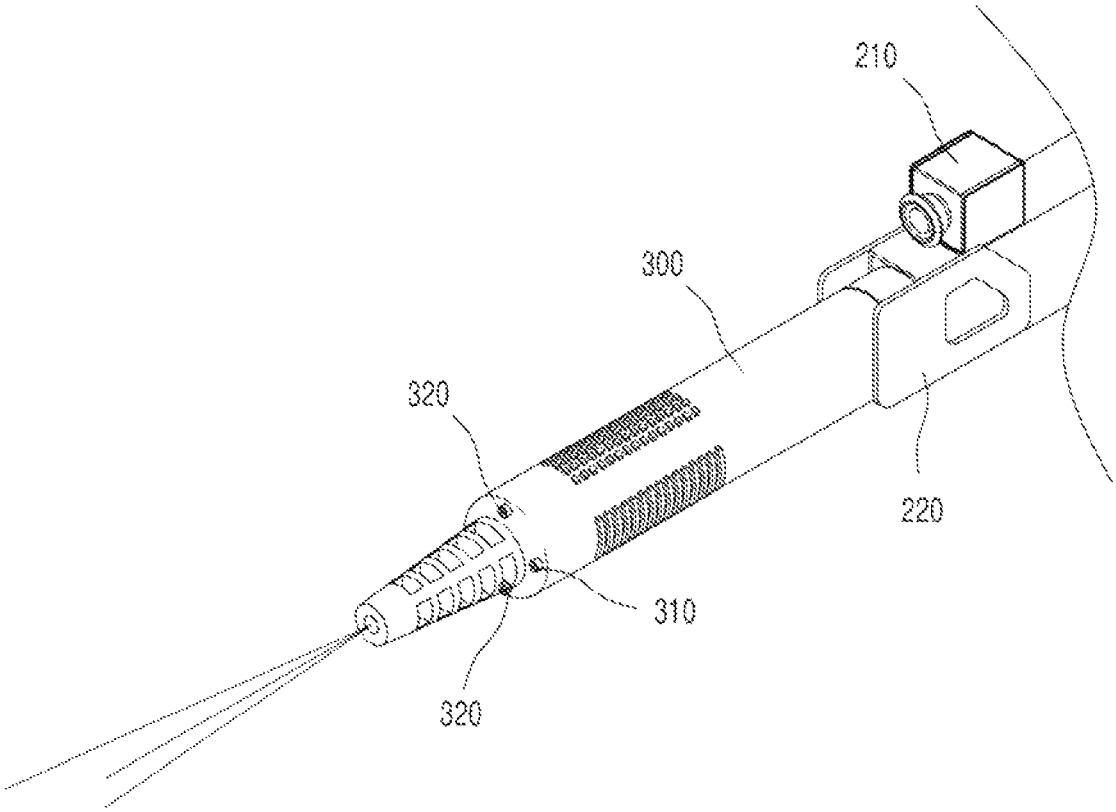
FIG. 4 is a view showing a tunnel excavating water jet nozzle according to an embodiment of the invention.

As described above, the water jet nozzle 300 is mounted on the front end of articulated robot arm 200. A plurality of water jet nozzles 300 may be employed. The water jet nozzle 300 can be configured such that it can be stretched back and forth. Referring to FIG. 4, the water jet nozzle 300 having the shape of a rod and a predetermined length is mounted on a support frame 220. The length to which the water jet nozzle 300 can be stretched can be controlled by the control unit 500. In tunnel excavation, the depth required for one-time blasting is generally 2 to 3 meters although it differs depending on the geological features of the rock base or the like. The stretchable length of the nozzle 300 is designed such that it can cover this range.

In addition, the water jet nozzle 300 can have a rotational part such that the rotational part of the water jet nozzle 300 rotates in order to sufficiently transfer the explosive force of water ejected from the water jet device 600 to the ground.

The water jet nozzle 300 includes a depth sensor part 310 and a width sensor part 320 at predetermined portions thereof which can measure the depth and width of cutting. Specifically, the depth sensor part 310 of the water jet nozzle 300 measures the depth of crushing from the free surface 20 which is crushed by high-pressure water. The control unit 500 controls the articulated robot arm 200 and the supply unit 400 based on the depth of crushing. In addition, the width sensor part 320 of the water jet nozzle 300 measures the width of crushing from the free surface 20 which is crushed by the high-pressure water. The control unit 500 controls the articulated robot arm 200 and the supply unit 400 based on the width of crushing. The depth sensor part 310 and the width sensor part 320 can be configured based on a laser.

The robot arm 200 has a plurality of posture control sensors in order to adjust the angle of inclination and the length or the nozzle, and controls the nozzle in real time depending on sensed values. In addition, a sensor is provided which senses when the rock base collapses in the state in which the nozzle is introduced into the free surface during operation.

The water jet nozzle 300 is required to operate so as to stretch back and forth while maintaining a predetermined distance from the rock base. The optimum distance between the rock base and the nozzle 300 is maintained by measuring the crushing of the rock, base using the distance sensor 310 and the width sensor part 320. In general, the distance between the rock base and the nozzle is measured to be about 10 cm so that optimum performance is obtained.

The tables below represent times spent for the formation of the free surface depending on the state of nozzles, distances and the like, which were measured by tests. The tests were carried out using two nozzles as one pair and by setting coupling angles jangles between the nozzles when the nozzles are coupled at sides) to 7.1° and 3.8°, depending on the distances from the rock base and the moving speeds of the nozzles (when the nozzles were linearly moved to the left and right without being stretched back and forth).

TABLE 1

| Nozzle moving speed (10 mm/s) | | | | | | | |
|---|---|---|---|---|---|---|---|
| Nozzle angle (°) | Average length (mm) | Average width (mm) | Spaced distance (cm) | Cutting type | Working time 2 pump (hr/1 m) | Working time 3 pump [hr/1 m] | Working time 4 pump [hr/1 m] |
| 7.1 | 70 | 37 | 10 | W | 1.0 | 0.7 | 0.5 |
| 7.1 | 60 | 45 | 20 | V | 1.2 | 0.8 | 0.6 |
| 7.1 | 45 | 45 | 30 | V | 1.5 | 1 | 0.8 |
| 3.8 | 50 | 60 | 10 | W | 1.4 | 0.9 | 0.7 |
| 3.8 | 38 | 65 | 20 | W | 1.8 | 1.2 | 0.9 |
| 3.8 | 35 | 70 | 40 | V | 2.0 | 1.3 | 1.0 |

TABLE 2

| Nozzle moving speed (20 mm/s) | | | | | | | |
|---|---|---|---|---|---|---|---|
| Nozzle angle (°) | Average length (mm) | Average width (mm) | Spaced distance (cm) | Cutting type | Working time 2 pump (hr/1 m) | Working time 3 pump [hr/1 m] | Working time 4 pump [hr/1 m] |
| 7.1 | 45 | 37 | 10 | W | 0.8 | 0.5 | 0.4 |
| 7.1 | 40 | 45 | 20 | V | 0.9 | 0.6 | 0.5 |
| 7.1 | 30 | 45 | 30 | V | 1.2 | 0.8 | 0.6 |
| 3.8 | 25 | 60 | 10 | W | 1.4 | 0.9 | 0.7 |

TABLE 2-continued

| Nozzle moving speed (20 mm/s) | | | | | | | |
|---|---|---|---|---|---|---|---|
| Nozzle angle (°) | Average length (mm) | Average width (mm) | Spaced distance (cm) | Cutting type | Working time 2 pump (hr/1 m) | Working time 3 pump [hr/1 m] | Working time 4 pump [hr/1 m] |
| 3.8 | 25 | 65 | 20 | W | 1.4 | 0.9 | 0.7 |
| 3.8 | 20 | 70 | 40 | V | 1.7 | 1.2 | 0.9 |

TABLE 3

| Nozzle moving speed (30 mm/s) | | | | | | | |
|---|---|---|---|---|---|---|---|
| Nozzle angle (°) | Average length (mm) | Average width (mm) | Spaced distance (cm) | Cutting type | Working time 2 pump (hr/1 m) | Working time 3 pump [hr/1 m] | Working time 4 pump [hr/1 m] |
| 7.1 | 38 | 37 | 10 | W | 0.6 | 0.4 | 0.3 |
| 7.1 | 30 | 45 | 20 | V | 0.8 | 0.5 | 0.4 |
| 7.1 | 25 | 45 | 30 | V | 0.9 | 0.6 | 0.5 |
| 3.8 | 20 | 60 | 10 | W | 1.2 | 0.8 | 0.6 |
| 3.8 | 19 | 65 | 20 | W | 1.2 | 0.8 | 0.6 |
| 3.8 | 15 | 70 | 40 | V | 1.5 | 1.0 | 0.8 |

In the tables above, the cutting shapes represent cutting shapes that were produced depending on the distances between the rock base and the nozzles when the nozzles were a pair of nozzles in the tests.

Conditions in the tests are presented in the following table.

Water Jet Pump

A water jet device having a high flow rate was used.

TABLE 4

| Maximum pressure | Pump power (HP) | Maximum flow rate (1/min) | Stably used flow rate (80% efficiency) | Used flow rate/ one nozzle |
|---|---|---|---|---|
| 2800 bar | 240 | 31 | 25 | 8.8 |

Orifice

No. 24 orifice was used (dia. 0.061 cm, 8.8 liters/min@2500 bar).

Focusing Nozzle

Inner diameter of a nozzle tip: 0.09 inch=2.29 mm.

Test Pressure and Amount or Abrasive Input

Test pressure: 2500 bar

Amount of an abrasive required: 57 g/s (per each)

In addition, the supply unit 400 creates the high-pressure water and supplies it to the water jet nozzle 300. The supply unit 400 can supply an abrasive along with the high-pressure water to the water jet nozzle 300. The abrasive can be interpreted as particles of sand or the like. The abrasive supplied to the water jet nozzle 300 is accelerated by the high-pressure water, and serves to increase the efficiency of the crushing and cutting of the surface to be excavated 10 together with the water. Of course, the control unit 500 can adjust the pressure of the water ejected through the water jet nozzle 300 and the amount of the abrasive required.

As described above, the control unit 500 of the invention controls the moving unit 100, the articulated robot arm 200 and the wafer jet nozzle 300. The control unit 500 controls the movement of the moving unit 100 on which the water jet nozzle 300 and the articulated robot arm 200 provided, and controls the speed of rotation of the rotational part of the water jet nozzle 300 and the pressure and direction of the water that is ejected from the water jet nozzle 300.

In addition, the invention using the water jet device 600 also includes a line recognizing means 210 which recognizes a predetermined color line L which is painted on the surface to be excavated 10 in order to perform crushing so that the free surface 20 is formed on the surface to be excavated 10. Such recognition can be carried out as follows: A worker paints the line in advance according to a targeted surface of the tunnel, and the device automatically recognizes the line via image recognition and controls the operation of the device 600 so as to form the free surface.

In addition to the above-described image recognition method, the method of automatically recognizing the position in which the free surface is to be formed can be carried out as follows.

A plurality of (preferably, at least three) locating terminals is disposed at the side of the entrance of a tunnel. The locating terminals acquire their positions by detecting signals from satellites, and each terminal sends position information including information about its position to the inside of the tunnel. The device 600 acquires distance information pertaining to the terminals and the position information of the terminals by analyzing the position information received from the locating terminals, and recognizes its three-dimensional (3D) position by operation. Afterwards, the free surface according to the tunnel excavation is formed by matching the recognized 3D position with 3D position information according to the tunneling plan which was input in advance. When the device cannot receive the signals because the tunnel is long, a repeater terminal is added in the middle of the tunnel so that the device can recognize its position. When the repeater terminal recognizes its position, the repeater terminal stores its position and sends position information based on its position. In this case, the terminal disposed at the side of the tunnel entrance may be removed. The terminal disposed at the side of the tunnel entrance can also be used as a repeater.

As an alternative, a laser or the like is used to emit information pertaining to the guideline in the direction of excavation from a specific rear point, and the device 600 detects the information and recognizes the 3D position of the device 600.

The emitted laser beam is linear in the 3D space, and the 3D position of the device can be acquired when only the information about the distance between the terminal and the device is operated. For this, the device 600 also includes a locating part (not shown) and a posture detecting part (not shown, which recognizes the position of the nozzle from information pertaining to the inclination thereof and the stretching of the nozzle). The device 600 can automatically form the free surface.

Figure 5:
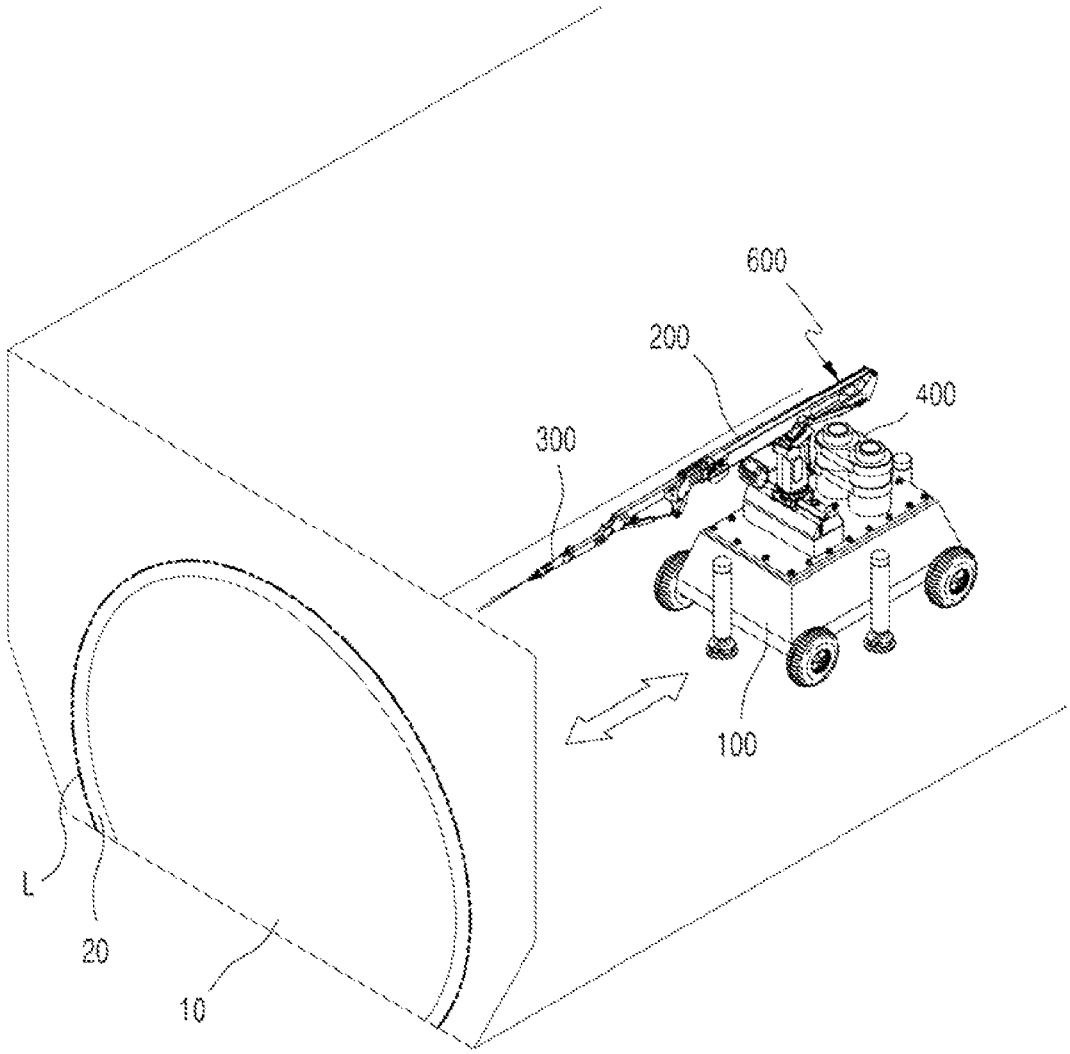
FIG. 5 is a view showing an example of the degree of freedom of an articulated robot arm according to an embodiment of the invention.
Figure 7:
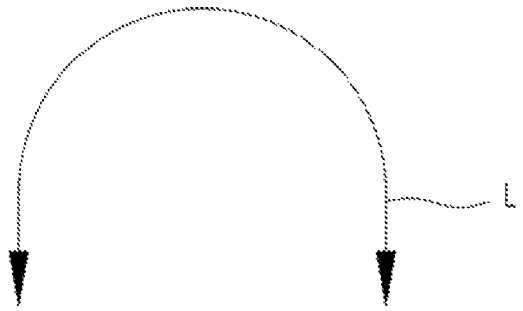
FIG. 7 is an illustrative view depicting the line of a pattern to be crushed defined by the water jet system of the invention.
Figure 7:
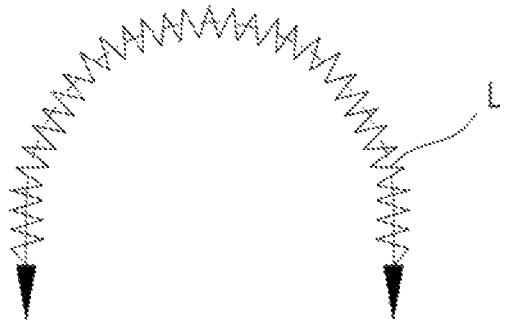

Referring to FIG. 5 and FIG. 7, the line L is a pattern to be crushed formed in the surface to be excavated 10.

The line L is the pattern to be crushed having the shape of an arch, and is a predetermined color line L that is drawn on the surface to be excavated 10.

In addition, the pattern to be crushed is basically the arch-shaped pattern, but can be a pattern to which a zigzag pattern is combined.

Here, the water jet nozzle 300 crushes the rock base along the zigzag pattern, and the free surface 20 has a predetermined width in the surface to be excavated 10.

Here, when the line L is formed as the pattern to be crushed, the control unit 500 controls the articulated robot arm 200 so that the water jet nozzle 300 follows the line L that is recognized by the line recognizing means 210.

The line recognizing means 210 which recognizes the line L can be implemented as a photographing means.

When the location of the device is completed in the above-described fashion according to one of the methods of locating the device, the line recognizing means 210 determines the present state of the free surface to be excavated 10, e.g. whether the free surface protrudes toward the device 600 or is caved in the direction of excavation.

When the determination is completed, prior to the main operation, a preliminary operation is carried out by moving the nozzle 300 to protruding portions which must be crushed first. The preliminary operation is carried out by dividing the entire area into sections and operating the robot arm.

That is, the control unit 500 controls the articulated robot arm 200 to move along the line L that is drawn on. the surface to be excavated 20, so that the water jet nozzle 300 mounted on the articulated robot arm 200 crushes the free surface 20 into the shape of the line L.

In this fashion, the articulated robot arm 200 moves along the line L, the water jet nozzle 300 forms an arch-shaped or zigzag trace while moving along with the articulated robot arm 200.

Consequently, the free surface 20, which is excavated into the arch or zigzag shape having a predetermined depth, is formed around the surface to be excavated 10. This free surface 20 is configured such that it is interposed between the surface to be excavated 10 and the surface of the earth and surrounds the surface to be excavated 10.

Figure 6:
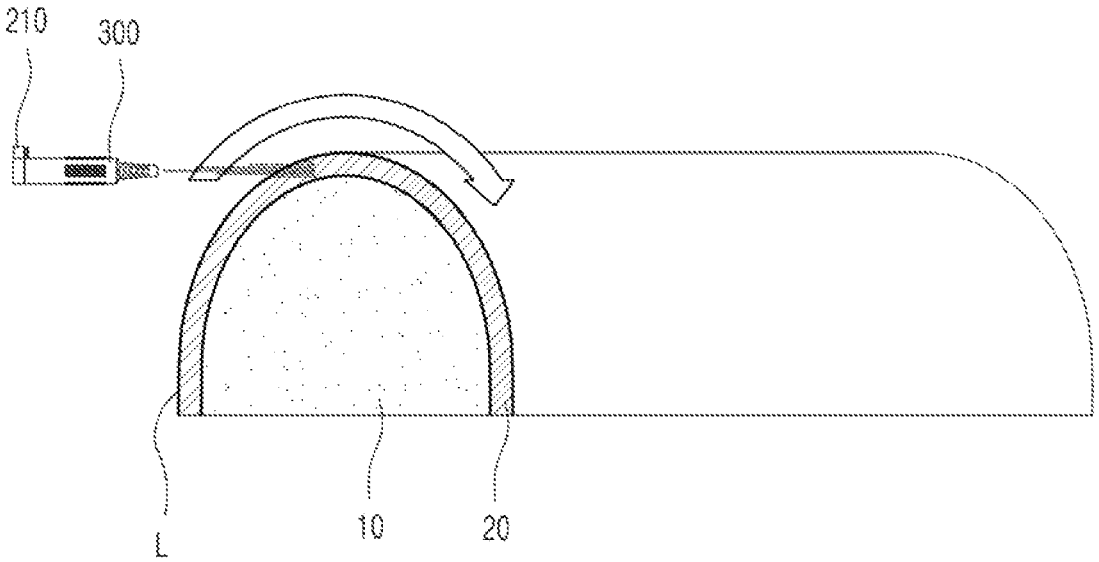
FIG. 6 is an illustrative view depicting a free surface defined by a water jet system of the invention.

In addition, the water jet device 600 can also include the line recognizing means 210 which recognizes the predetermined color line L painted on the surface to be excavated 10. Referring to FIG. 5 to FIG. 7, the arch-shaped line L is painted on the surface to be excavated 10. The line L can be understood as the substantial pattern that is to be crushed using the water jet device 600 of the invention. The pattern to the crushed is basically the arch-shaped pattern, but can be a pattern to which a zigzag pattern is combined.

Specifically, the control unit 500 controls the articulated robot arm 200 so that the water jet nozzle 300 follows the line L that is recognized using the line recognizing means 210. The line recognizing means 210 can be implemented as a photographing means. Thus, the free surface 20 is formed along the line L. For reference, as illustrated in FIG. 7, the control unit 500 controls the articulated robot arm 200 so that it basically follows the arch-shaped line L, and can also control the articulated robot arm 200 so as to draw the zigzag trace considering the width of crushing. Consequently, the free surface 20, which is excavated into the arch or zigzag shape having a predetermined depth, is formed around the surface to be excavated 10.

When the free surface is formed, the space inside the free surface is photographed using a camera mounted on the nozzle, and the status of the rock base is inspected. A possibility of collapse during the subsequent process of blasting a charge or constructing the tunnel is predicted in order to increase the safety of the subsequent construction.

Figure 8:
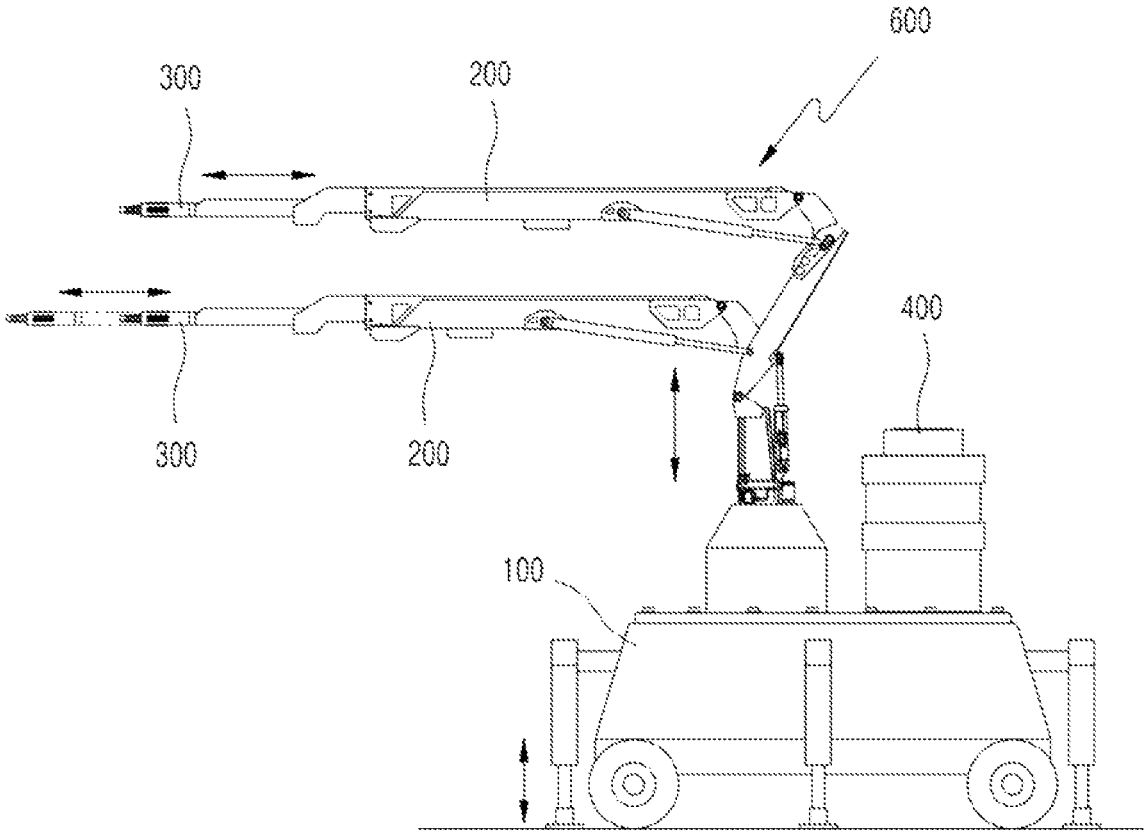
FIG. 8 is a view showing a tunnel excavating water jet device according to another embodiment of the invention.

FIG. 8 is a view showing another embodiment of the invention. Referring to FIG. 8, according to another embodiment of the invention, a tunnel excavating water jet device 600 has two articulated robot arms 200 and water jet nozzles 300. Each of the articulated robot arms 200 supports a corresponding water jet nozzle 300. As indicated with arrows in the figure, both the height and length of the water jet nozzle 300 can be adjusted.

The water jet device 600 will be described as follows. Components of the water jet device include the articulated robot arm 200, a distance measuring sensor, a temperature monitoring sensor, a suction system, a depression detection system.

More specifically, the articulated robot arm 200 is designed such that the free surface 20 can be formed without the problem of device malfunction caused by errors in the free surface 20 and the speed of movement of the articulated robot arm 200 can be controlled.

The distance measuring sensor is attached to the water jet nozzle 300, and is configured so as to stop operating when no targets are present within a predetermined distance.

In addition, the temperature monitoring sensor is configured such that it can measure a temperature range recognizable as a human at an excavating point in order to prevent an accident.

The suction system is configured such that the suction system takes in water and discharges it to another area when the water flows as the rock base is crushed. This can consequently prevent deposition and thus increase the speed at which the free surface 20 is formed. The depression detection system is configured such that it can detect the position or portion of the free surface 20 that is depressed and whether or not water jet nozzle 300 is damaged by the depressed ground. If the water jet nozzle 300 is damaged, a design or configuration that facilitates replacement and reassembly is provided.

In addition, it is configured such that, when the water jet nozzle 300 does not properly move when forming the free surface 20, the reasons can be identified.

Figure 9:
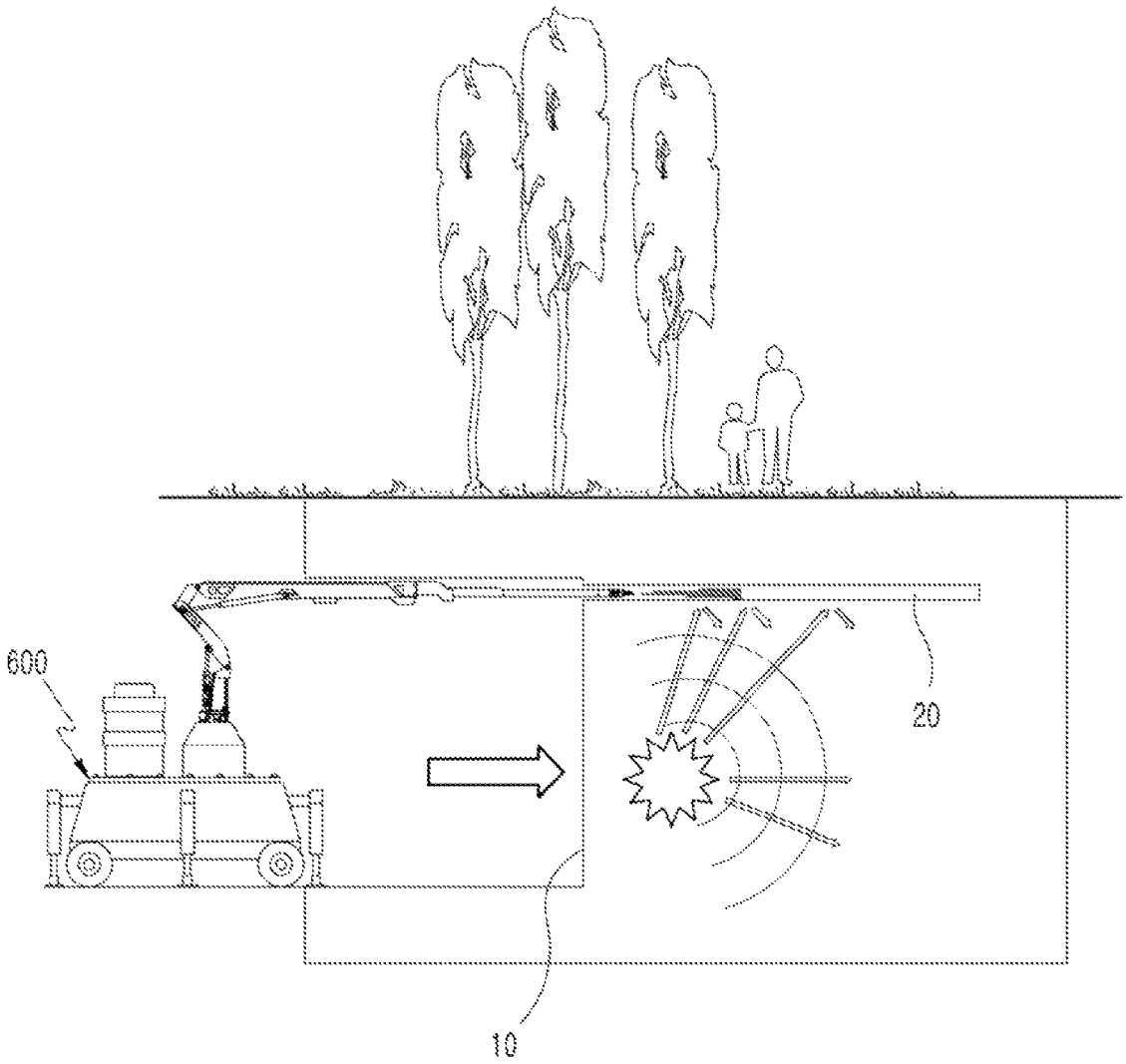
FIG. 9 is a view depicting a tunnel excavation method using a water jet system of the invention.

Hereinafter, with reference to FIG. 9 and FIG. 10, a description will be given below of an excavation method using the water jet according to an embodiment of the invention.

First, the water jet device 600 is moved to an excavation position using the moving unit 100.

When the device 600 is seated in position, the device determines the present status by scanning its own position and the portion that is to form the free surface, and starts the preliminary operation using the nozzle 300. It is preferable that the nozzle move along the line L while being reciprocated and rotated, thereby effectively forming the free surface. It is preferable that the free surface be formed by operating the robot arm after the depth of the free surface is formed uniform by first treating the convex portions determined by scanning.

Afterwards, the pattern to be crushed that is defined by the line L is formed in the surface to be excavated 10.

The pattern to be crushed is formed by selecting the arch-shaped or zigzag pattern and painting the line L having a predetermined color on the surface to be excavated 10.

The control unit 500 recognizes the line L formed on the surface to be excavated 10 via the line recognizing means 210, and controls the water jet nozzle 300 so as to follow the line L.

When a plurality of robot arms 200 is provided, the operation can be carried out by dividing the area into sections, and the sequence and time of operation is respectively controlled according to the robot arms such that the robot arms 200 do not interfere with each other.

The control unit 500 controls the articulated robot arm 200 so as to move along the line L, so that the free surface 20 is formed in the planned shape of the line L.

The free surface 20 is formed to a predetermined depth in the surface to be excavated 10 using the water jet nozzle 300.

The step of measuring the free surface 20 measures the crushed depth and width of the free surface 20, which is crushed by the water jet nozzle 300, in real time using the sensors. When the measured width or depth does not exceed a reference value, the nozzle 300 is operated again in the corresponding portion in order to achieve the intended width and depth.

When the depth and space of the free surface 20 is not achieved, an initial execution command is fulfilled, and when the depth and space of the free surface 20 is achieved, a blasting preparation step is carried out.

When the process of forming the free surface 20 is completed in this fashion, a plurality of charge holes 30 is subsequently formed in the inner area of the free surface 20 using the water jet nozzle 300. After that, the charge holes 30 are charged with explosives, which in turn cause blasting.

In addition, the pattern to be crushed according to the invention can form the free surface 20 so as to be continuous along the line L, or the designed excavation line of the portion to be excavated. The continuous free surface 20 can reduce the transfer of vibration and noise, thereby reducing blast vibration. Unlike the related art in which blasting is carried out in the state in which only the front side with respect to the direction in which the tunnel is excavated is opened and the upside, downside, left side, right side and the rear side are closed by the adjacent rock base, the invention carries out blasting in the state in which only the downside and rear side are closed by the adjacent root base but the front side, the upside, the left side and the right side are opened. Accordingly, since the free surface 20 is increased, the amount of a charge that is required is minimized. This consequently reduces impact, vibration and noise that are transferred, thereby enabling a more safe and environmental-friendly blasting process.

In addition, when the explosives charged in the charge hole 30 are blasted, vibration, noise and destructive force that occur spread in all directions through the rock base 10 to be excavated, which acts as a medium. However, the vibration, noise and destructive force are deflected or reflected toward the rock base 10 from around the free surface 20 because of the difference between media (i.e. the rock base and air). This is the same as the principle in which sound generated inside water is efficiently transferred inside the water but is not heard in the air outside the water.

Consequently, the free surface 20 effectively blocks and reduces the vibration and noise that are generated by the explosion.

In the related art, the destructive force generated by the explosion is propagated in all directions along the rock base, thereby causing a great amount of loss. In contrast, according to the invention, the destructive force is deflected by the free surface 20 and is directed inward again (see FIG. 9). Consequently, this can destroy the rock base to be excavated using a small amount of destructive force, thereby reducing the amount of explosives required.

Figure 10:
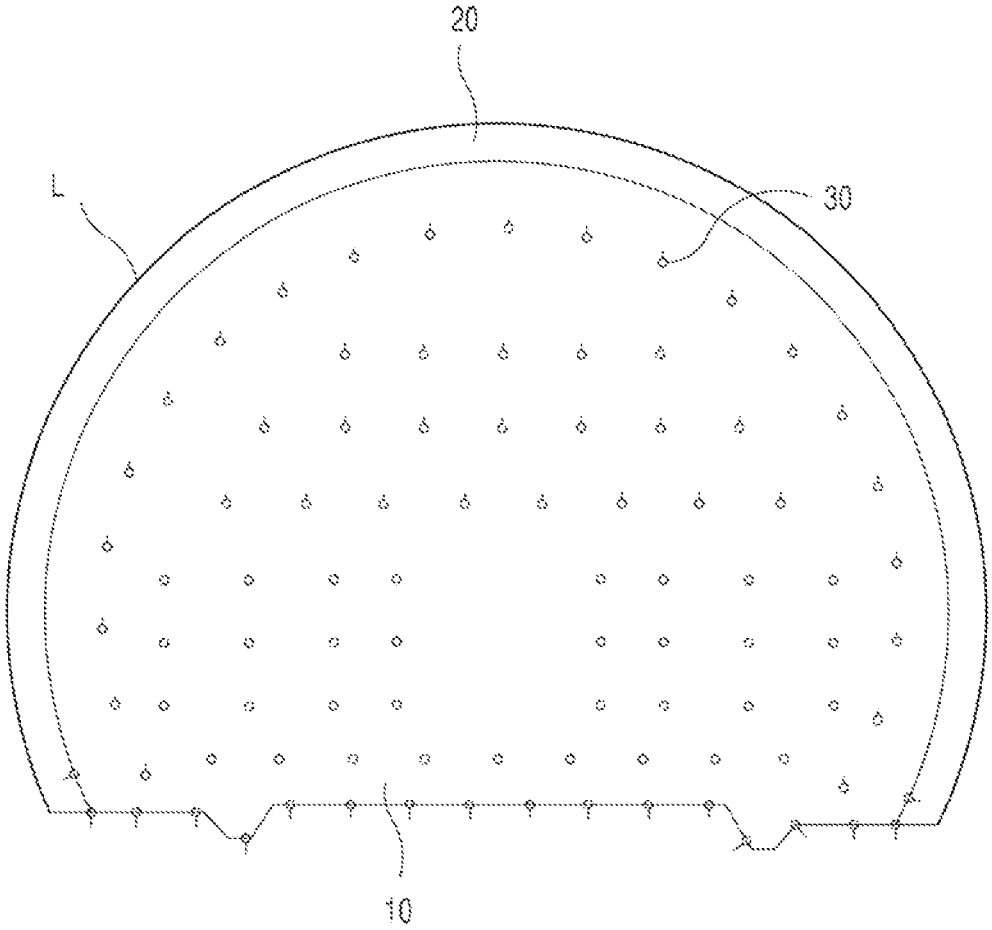
FIG. 10 a view showing charge holes in a surface to be excavated in which a free surface is formed according to the invention.

As shown in FIG. 10, a plurality of charge holes 30 having a predetermined depth are formed at equal distances in the surface (the surface to be excavated 10) inside the free surface 20, and explosives are charged in the charge holes 30.

The charge holes 30 can be formed using the water jet according to the invention, or be formed using an existing jumbo drill. In addition, when a plurality of robot arms 600 is mounted, the robot arms 600 can be operated so that some of the robot arms 600 form the free surface and the other robot arms 600 form the charge holes.

Afterwards, the tunnel excavation is carried out by blasting the surface to be excavated 10.

The sequence of the blasting is as follows: Some of the explosives which are adjacent to the free surface 20 are blasted first, and the blasting is sequentially directed toward the center and the bottom of the tunnel. Specifically, the blasting is started at the portions that are adjacent to the front side, the left and right free surfaces and the upper free surface, and then the charges in the rock base which are inside and in the bottom of the tunnel sequentially explode. In addition, since the charge holes are generally formed to a depth ranging from 2 m to 3 m, it is possible to carry out sequential blasting instead of simultaneously exploding all of the charge in a corresponding charge hole. For example, part of the explosives that are positioned outermost (adjacent to the front, left, right and upper free surface portions) are exploded first, and explosion is sequentially carried out in the inward direction. When the blasting is carried out in this fashion, the part of the rock base that has more areas corresponding to the free surface is exploded first, thereby reducing the amount of charges.

Hereinafter, a detailed description will be given below of an excavation system using a water jet according to another embodiment of the invention.

Figure 11:
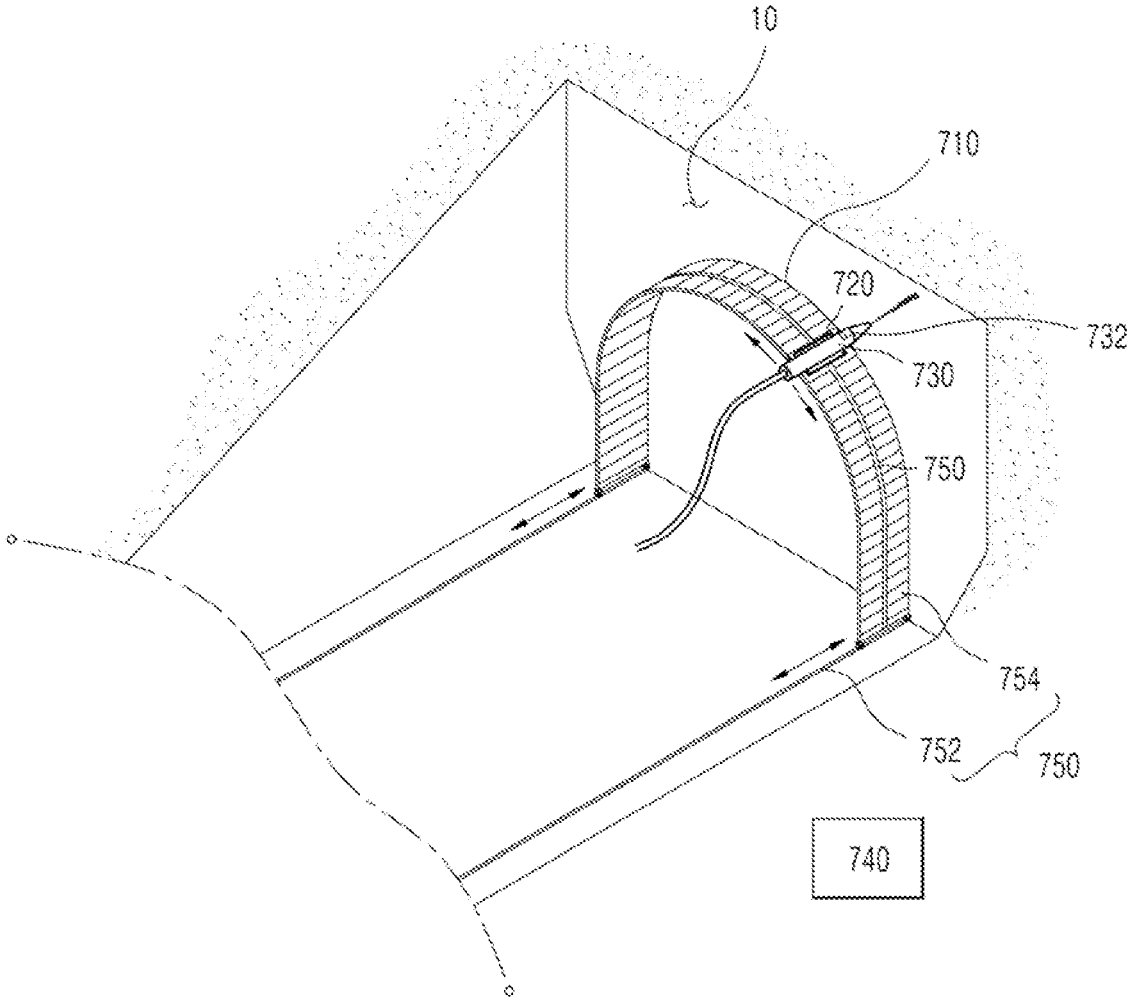
FIG. 11 is a view showing a frame-type tunnel excavating water jet device according to another embodiment of the invention.
Figure 12:
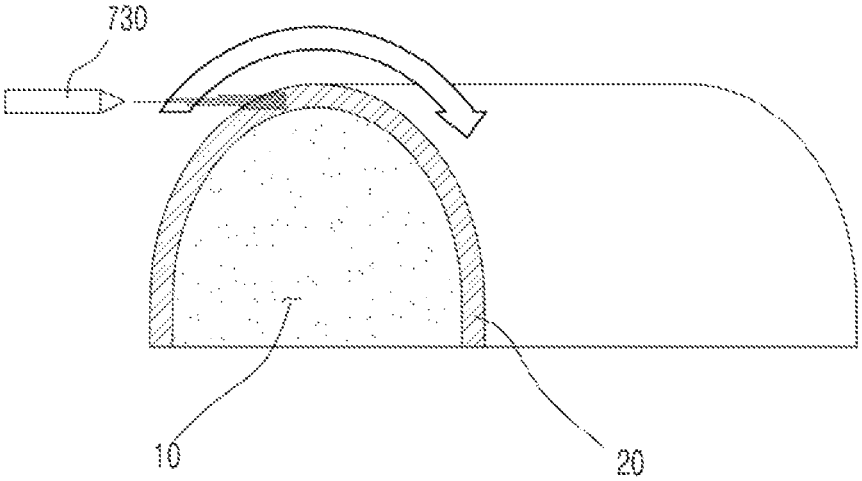
FIG. 12 is an example view depicting a free surface which is formed by the water jet system shown in FIG. 1.

Referring to FIG. 11 and FIG. 12, a water jet system includes a frame 710, a moving means 720, a water jet nozzle 730 and a control device 740.

More specifically, the frame 710 is disposed in front of the surface to be excavated 10. As shown in the figure, the frame 710 has the shape of an arch similar to the cross-sectional shape of the tunnel, and can move in the direction in which the tunnel is excavated. A rail 750 is provided in the frame 710, The moving means 720 is movably meshed, to the rail 750. The moving means 720 reciprocates along the rail 750 under the control of the control device 740. The moving means 720 may move the frame 710 using wheels or a caterpillar without using the rail.

The object that the moving means 720 is to move is the water jet nozzle 730. The water jet nozzle 730 ejects high-pressure water to the front side of the surface to be excavated 10. The high-pressure water is supplied by a water supply unit (not shown). According to the invention, surface to be excavated 10 is broken (or crushed) by the water elected from the water jet nozzle 730. An abrasive may be used together in order to increase the performance. The abrasive is particles of sand or the like, and is supplied to the wafer jet nozzle 730 by an abrasive supply unit (not shown). Consequently, the water jet nozzle 730 ejects the water and the abrasive, which is accelerated by the water, in the direction toward the surface to be excavated 10. The control device 740 can adjust the pressure of the water ejected through the wafer jet nozzle 730 and the amount of the abrasive required. Since the water jet nozzle 730 is fixed to and supported on the moving means 720, it reciprocates along the rail 750.

Here, the moving means 720 includes the rail 750, which includes a first rail 752 which enables the frame 710 to move back and forth and a second rail 754 which enables the water jet nozzle 730 to move.

The first rail 752 is provided to enable forward and backward movement of the frame 710, and the second rail is positioned on the frame 710 such that the water jet nozzle 730 can move along the second rail. The water jet nozzle 730 is mounted on the moving means 720 such that if can reciprocate on the second nozzle 754. In addition, it can also be configured such that the water jet nozzle 730 is mounted on the robot arm, which was described above, and the robot arm is mounted on the frame 710, such that the robot arm can move along the frame.

Since the water jet nozzle 730 moves along the frame 710, its movement draws an arch-shaped trace which resembles the shape of the frame. Consequently, an arch-shaped free surface 20 having a predetermined depth is formed around the surface to be excavated 10. The free surface 20 is interposed between the surface to be excavated 10 and the ground surface, and has the shape that surrounds the surface to be excavated 10.

Here, the water jet nozzle 730 can move using the moving means 720, and a plurality of the water jet nozzle can be employed. The water jet nozzle 730 can include a measurement sensor 732 at one side thereof, which measures the cut depth.

In addition, the control device 740 controls the moving speed of the moving means 720 and the pressure and direction of the water ejected from the water jet nozzle 730. Here, an auxiliary material, such as the abrasive, can be mixed with the water ejected from the water jet nozzle 730 in order to increase the efficiency of excavation.

A description will be given of the process of forming the free surface 20 using the water jet system. First, the frame 710 is moved to an excavation position along the first rail 752. Afterwards, the control device 740 determines the pressure of the water jet nozzle 730, the moving speed of the moving means 720 and the amount of the abrasive required.

Since the water jet nozzle 730 moves along the frame 710, its movement draws an arch-shaped trace which resembles the shape of the frame. Consequently, the arch-shaped free surface 20 having a predetermined depth is formed around the surface to be excavated 10. The free surface 20 is interposed between the surface to be excavated 10 and the ground surface, and has the shape that surrounds the surface to be excavated 10.

When the process of forming the free surface 20 is completed, the moving means is moved back along the first rail 752 from the surface to be excavated 10. Afterwards, a plurality of charge holes is formed in the surface to be excavated 10, followed by charging and blasting. During the blasting, blasting vibration (vibration energy) is generated from the source of explosion. The free surface 20 deflects the blasting vibration, thereby effectively preventing or reducing the propagation of the blasting vibration to the surroundings including the ground surface.

In addition, the majority of the blasting vibration deflected from the free surface 20 acts again as energy required for the blasting. Therefore, the amount of explosives required for the blasting can be reduced than the case without the free surface 20. In addition, the possibility of overbreak after the blasting can be significantly reduced. This means that subsequent processing after the blasting is unnecessary, leading to the reduced construction cost and shortened construction period.

EXAMPLES

Figure 13A:
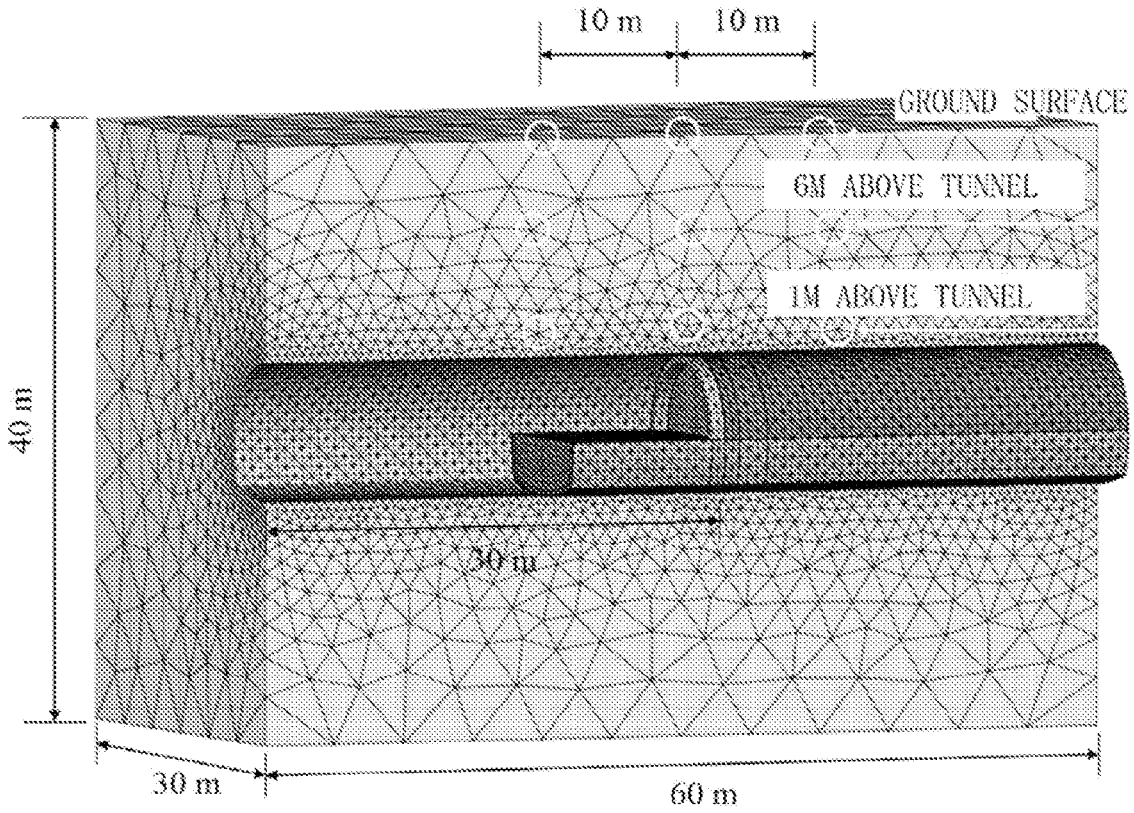
FIG. 13 is a view showing a three-dimensional (3D) finite element analysis model.
Figure 13B:
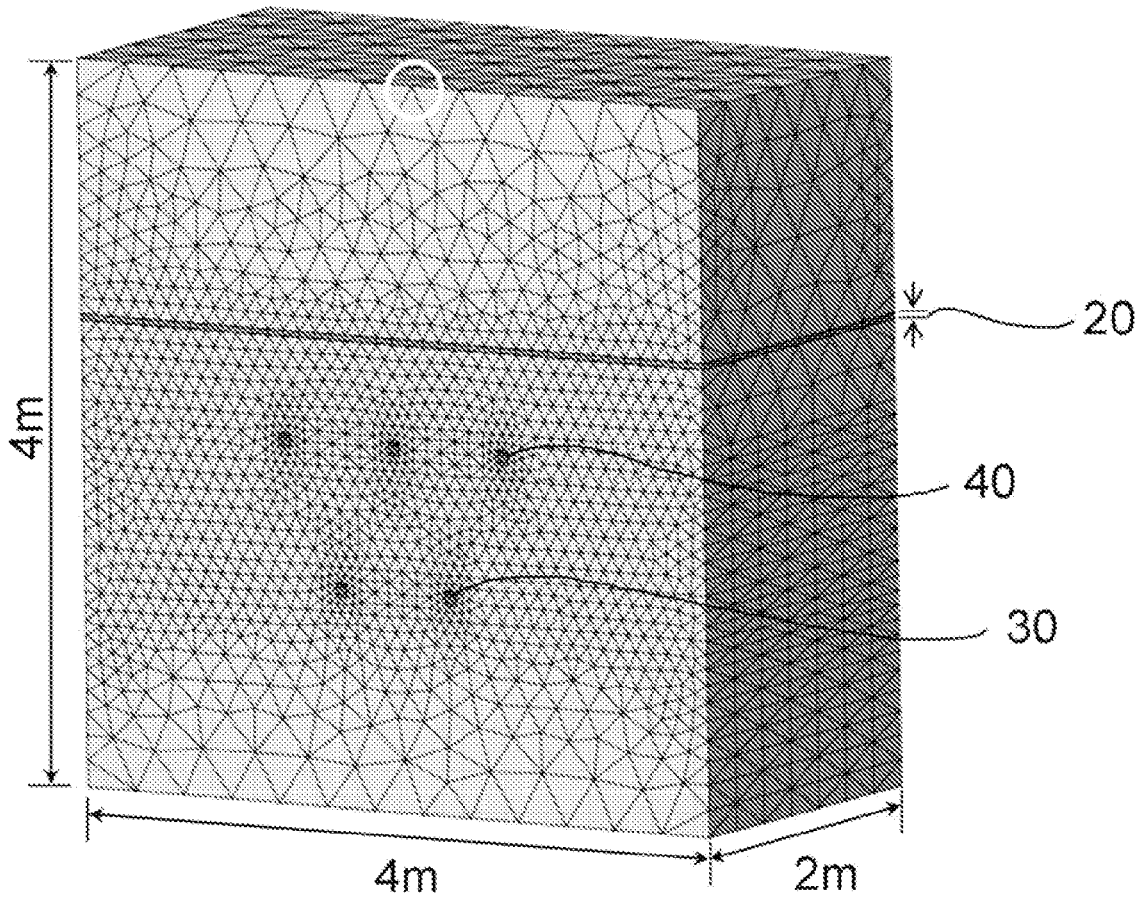

FIG. 13 to FIG. 20 are the results of simulation for reducing blasting vibration by forming a free surface. FIG. 13 is a view showing 3D finite element analysis model, and represents the positions of contour holes 40 and stopping holes 30.

Figure 14A:
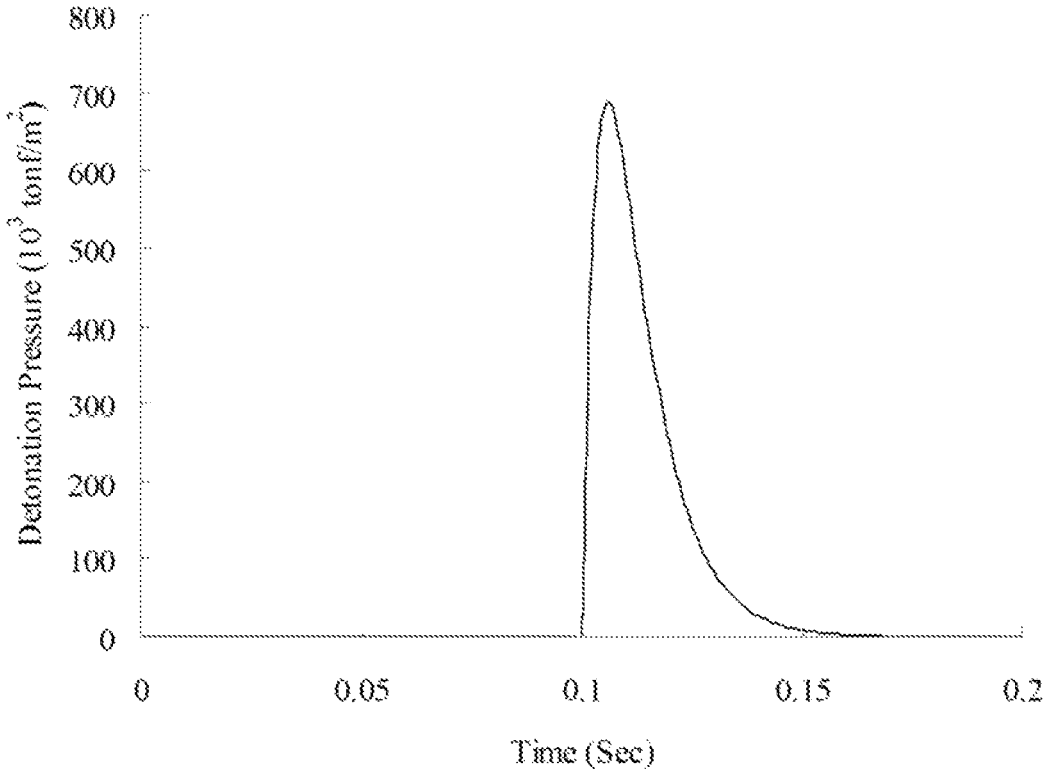
FIG. 14 is a view of simulated blast pressures depending on the time.
Figure 14B:
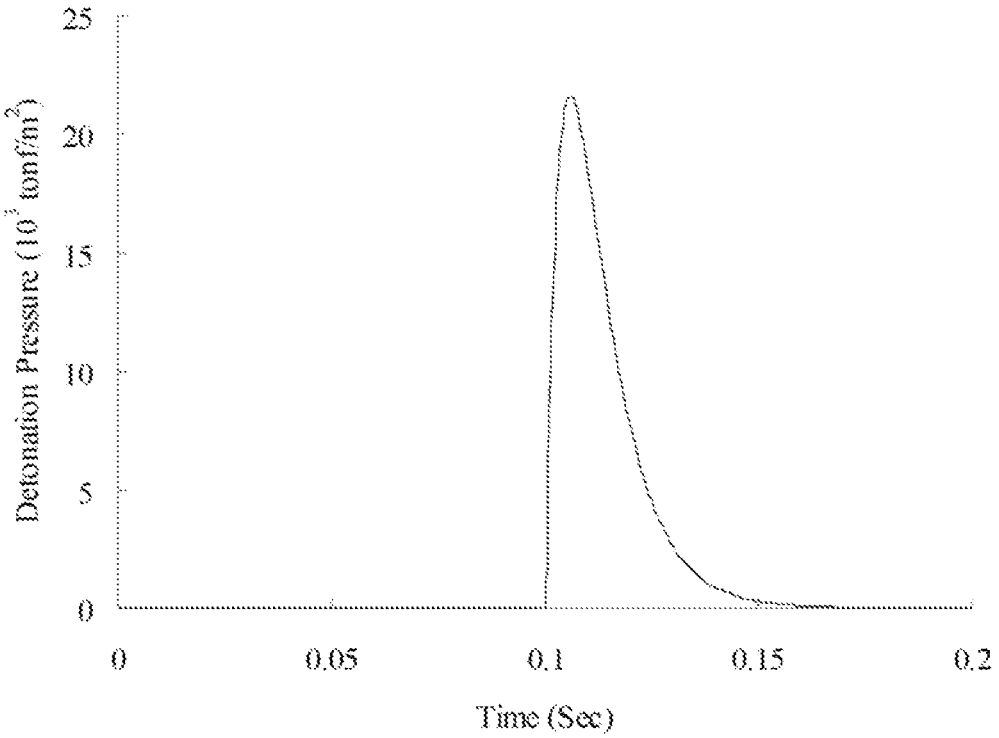

FIG. 14 is a view of simulated blast pressures depending on the time, in which (a) represents the blast pressure at the stopping hole 30, and (b) represents the blast pressure at the contour hole 40. Here, the charging conditions of the contour holes (40, see FIG. 13) include decoupling Gurit having a diameter of 17 mm, a fine explosive, and the charging conditions of the stopping holes (30, see FIG. 13) including charging emulsion explosives having a diameter of 32 mm. The difference in the blast pressure between the stopping holes 30 and the contour holes 40 is not significant. Blast vibration is not greatly influenced by whether or not the contour holes 40 are blasted.

Figure 15A:
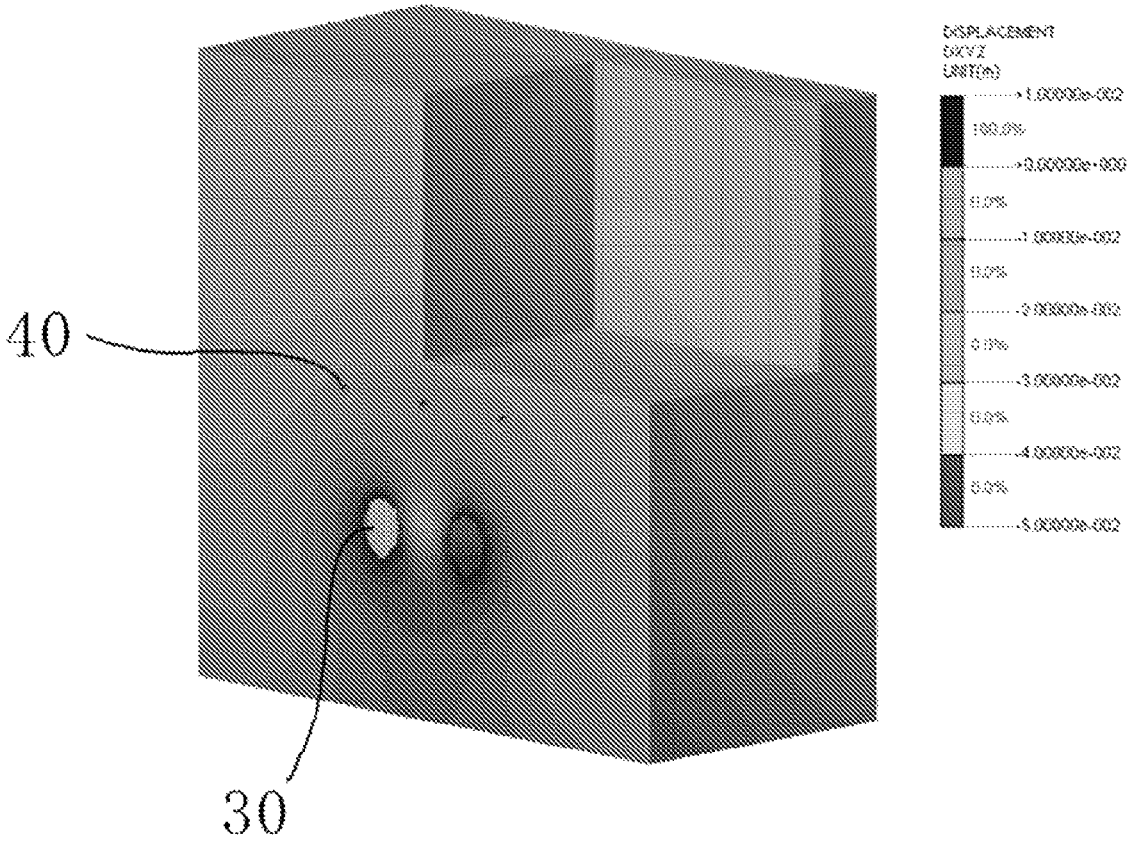
FIG. 15 is a view of simulated synthetic displacements in XYZ directions.
Figure 15B:
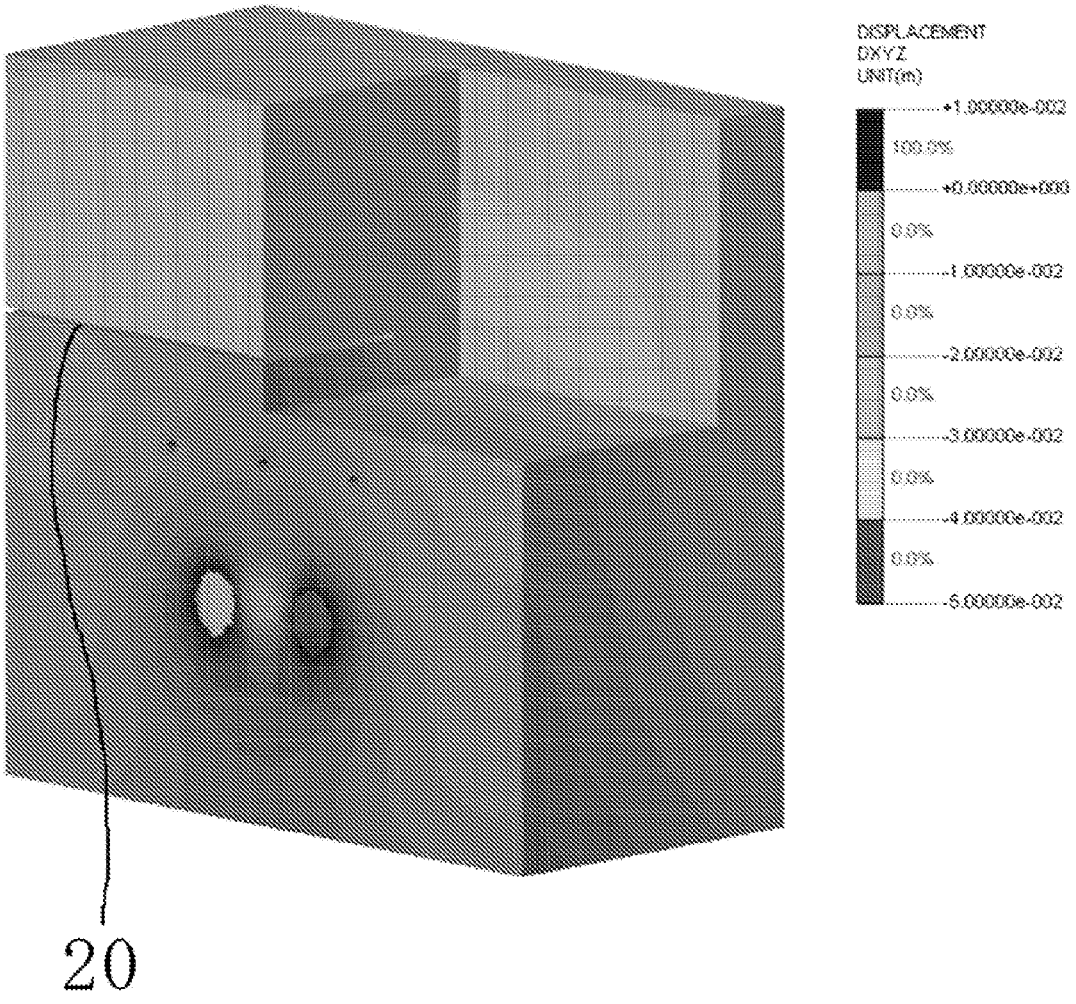
Figure 15C:
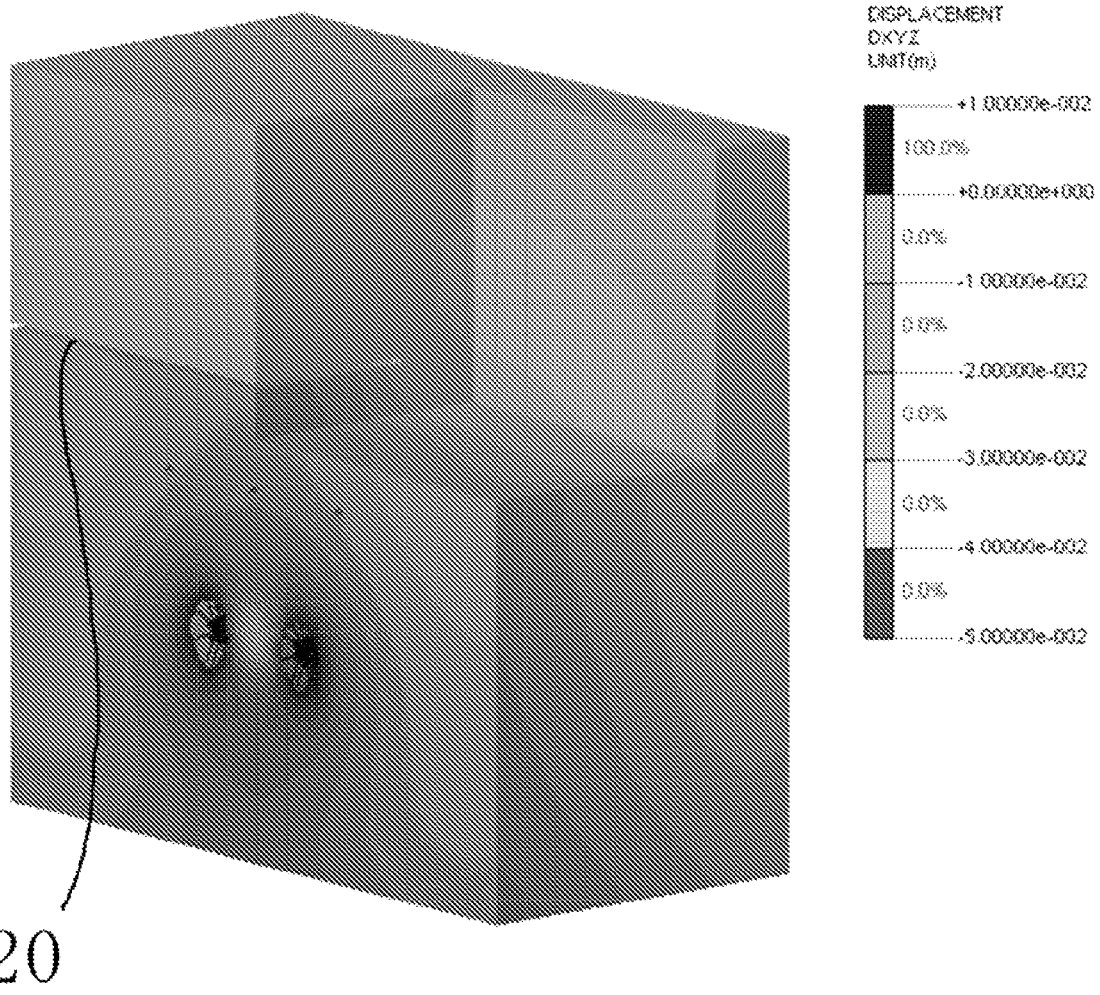
Figure 16A:
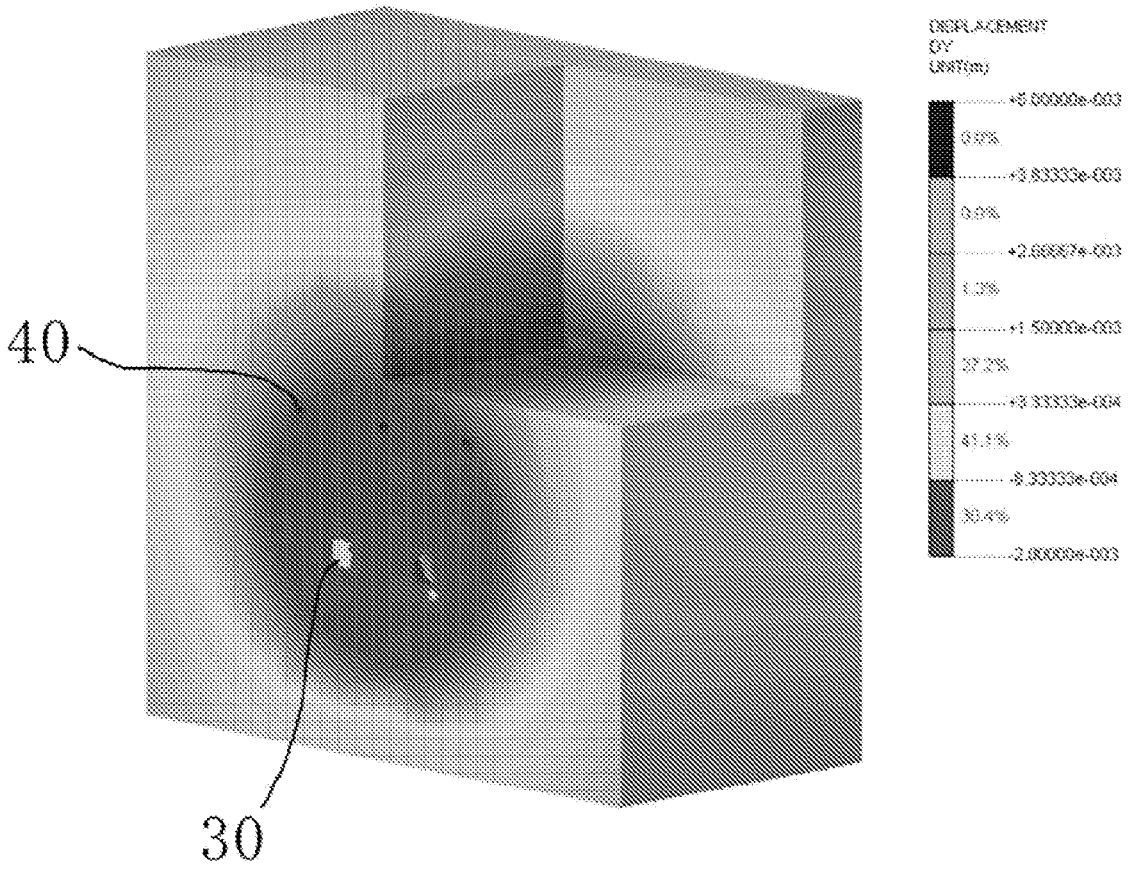
FIG. 16 is a view of simulated displacements in the horizontal direction.
Figure 16B:
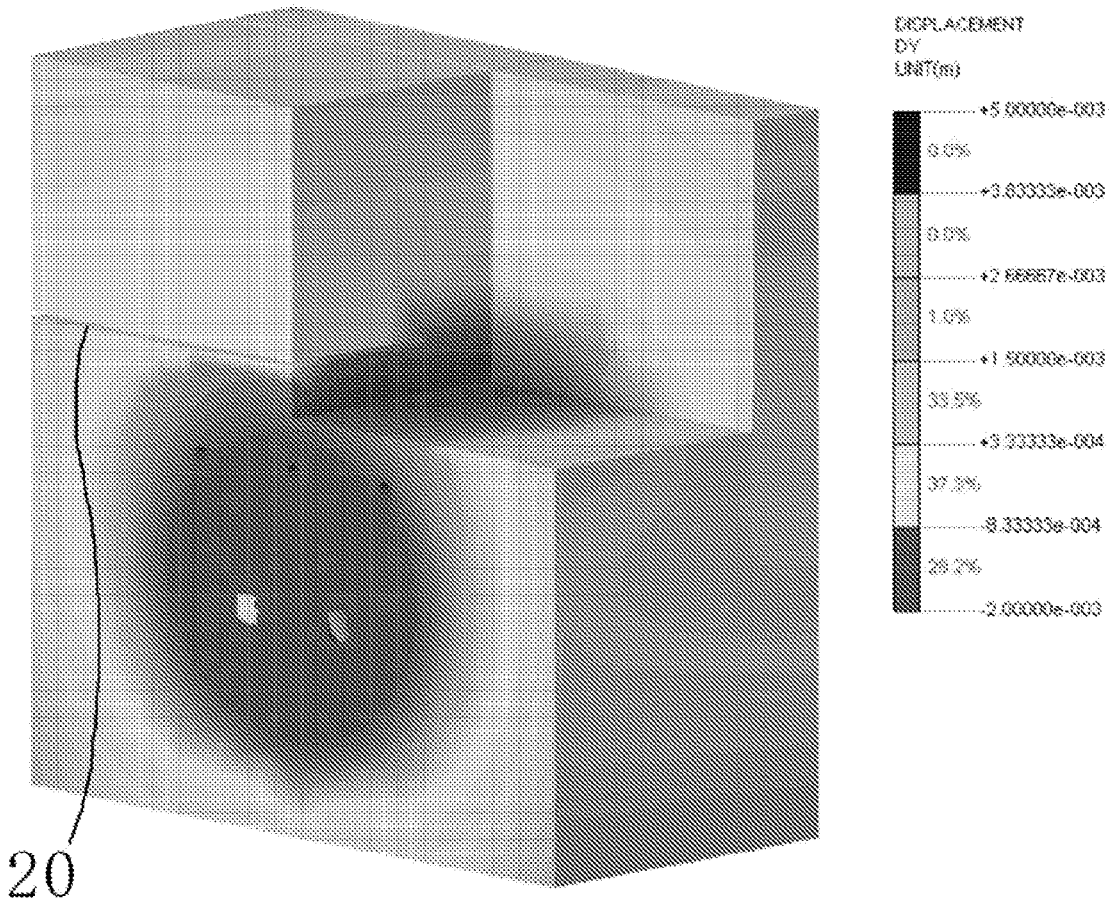
Figure 16C:
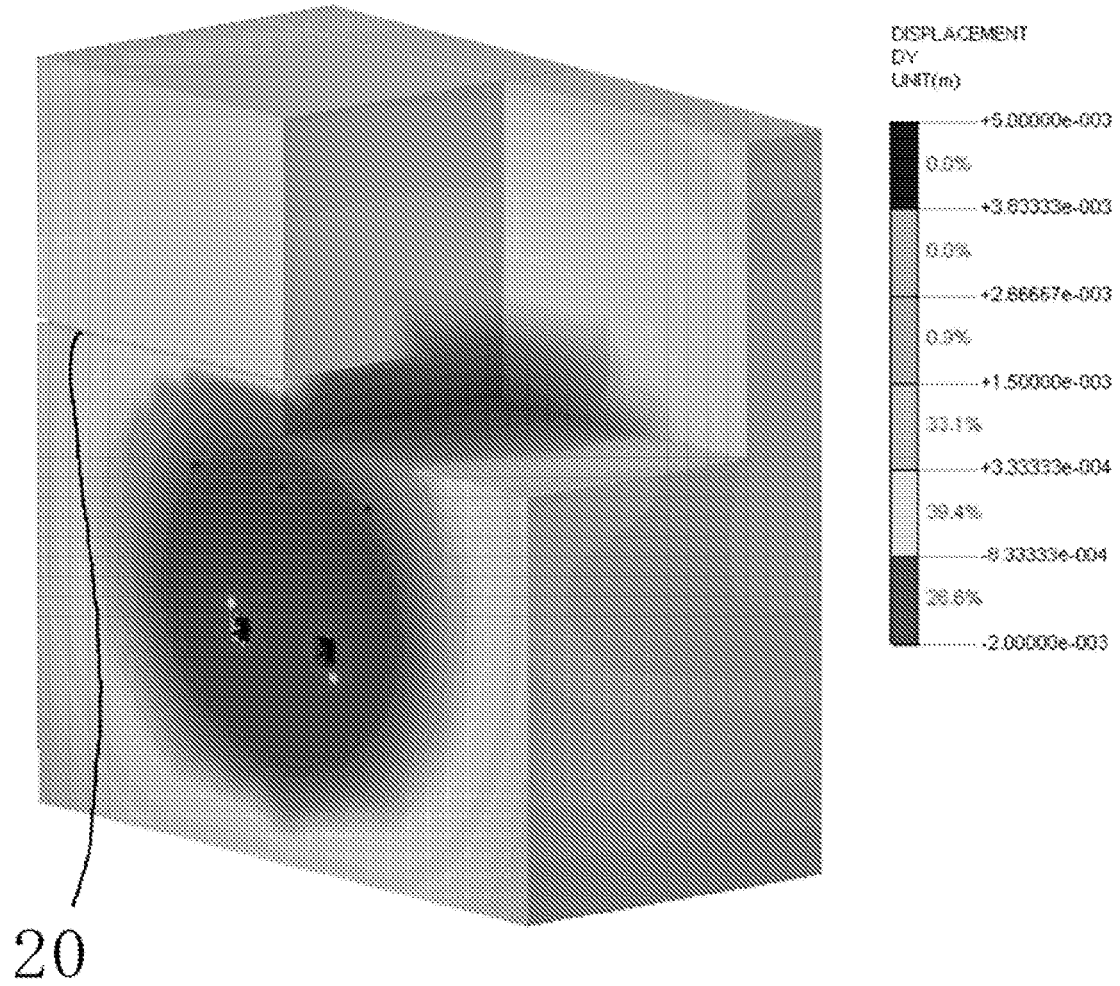
Figure 17A:
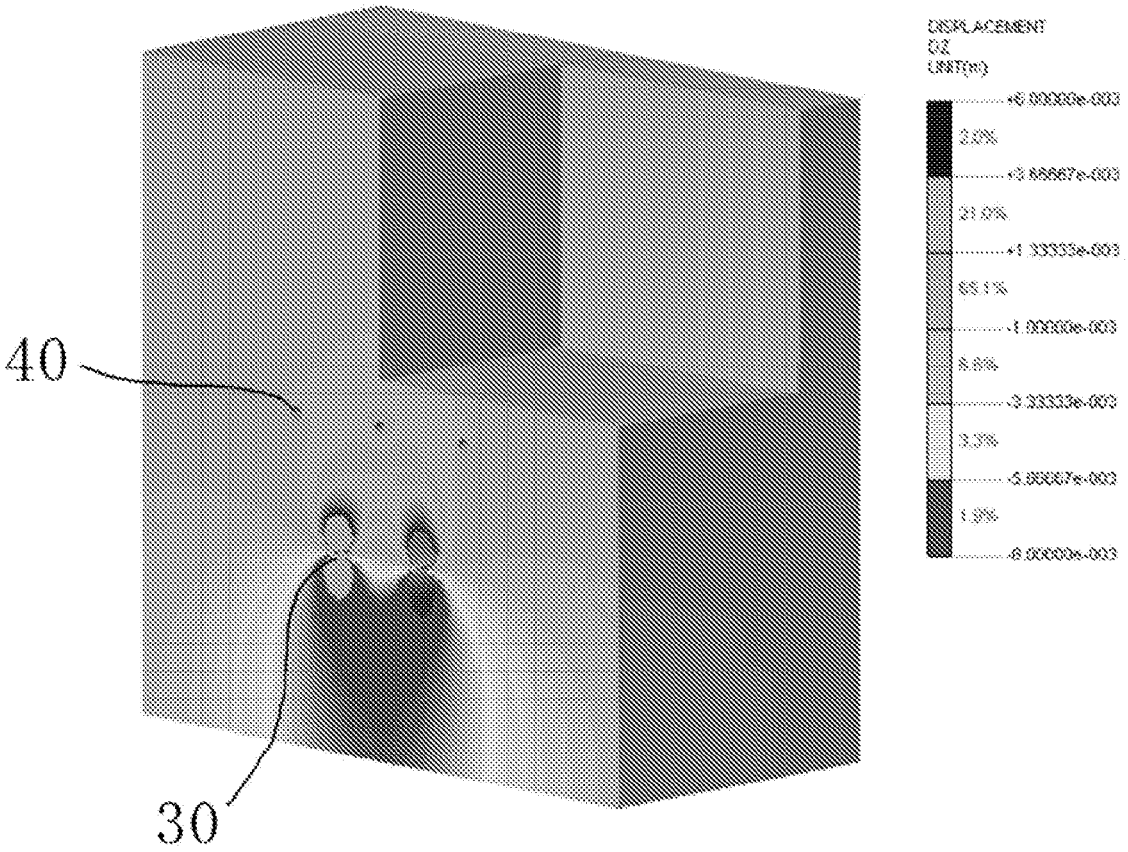
FIG. 17 is a view of simulated displacements in the vertical direction.
Figure 17B:
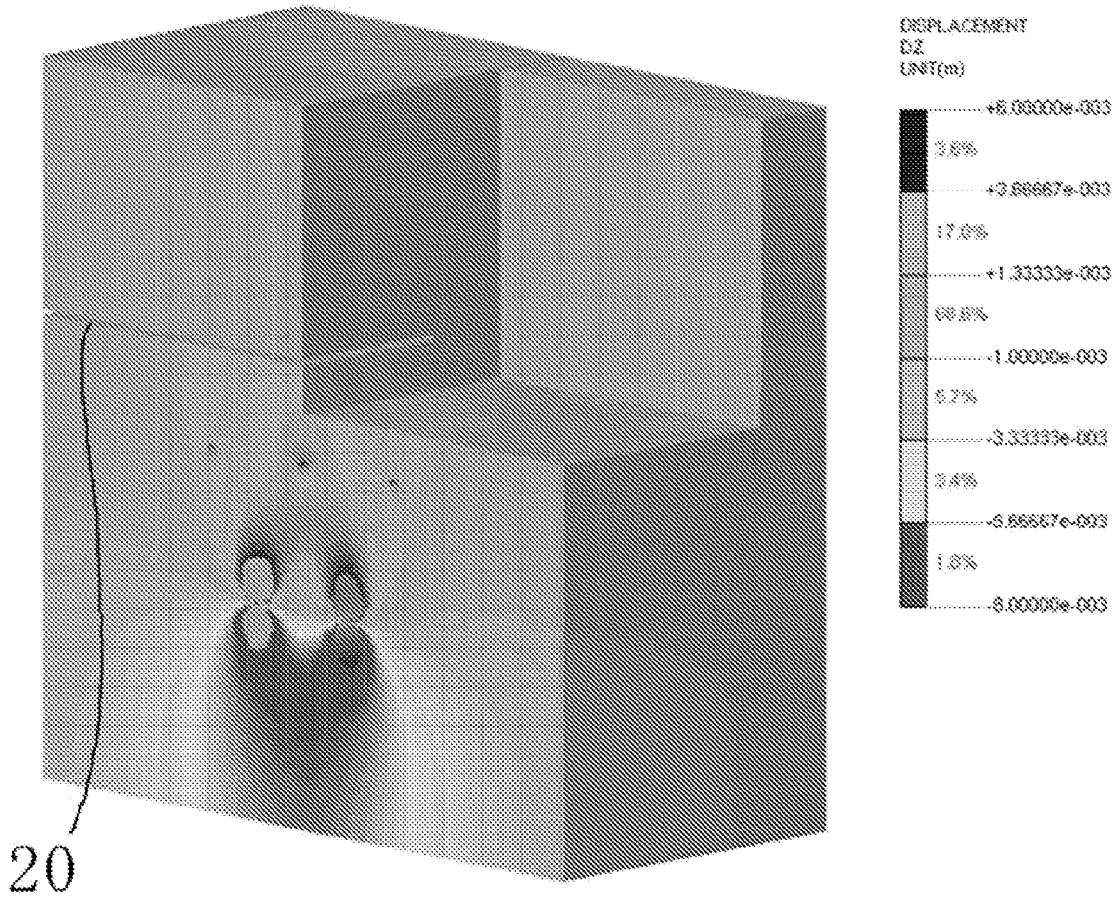
Figure 17C:
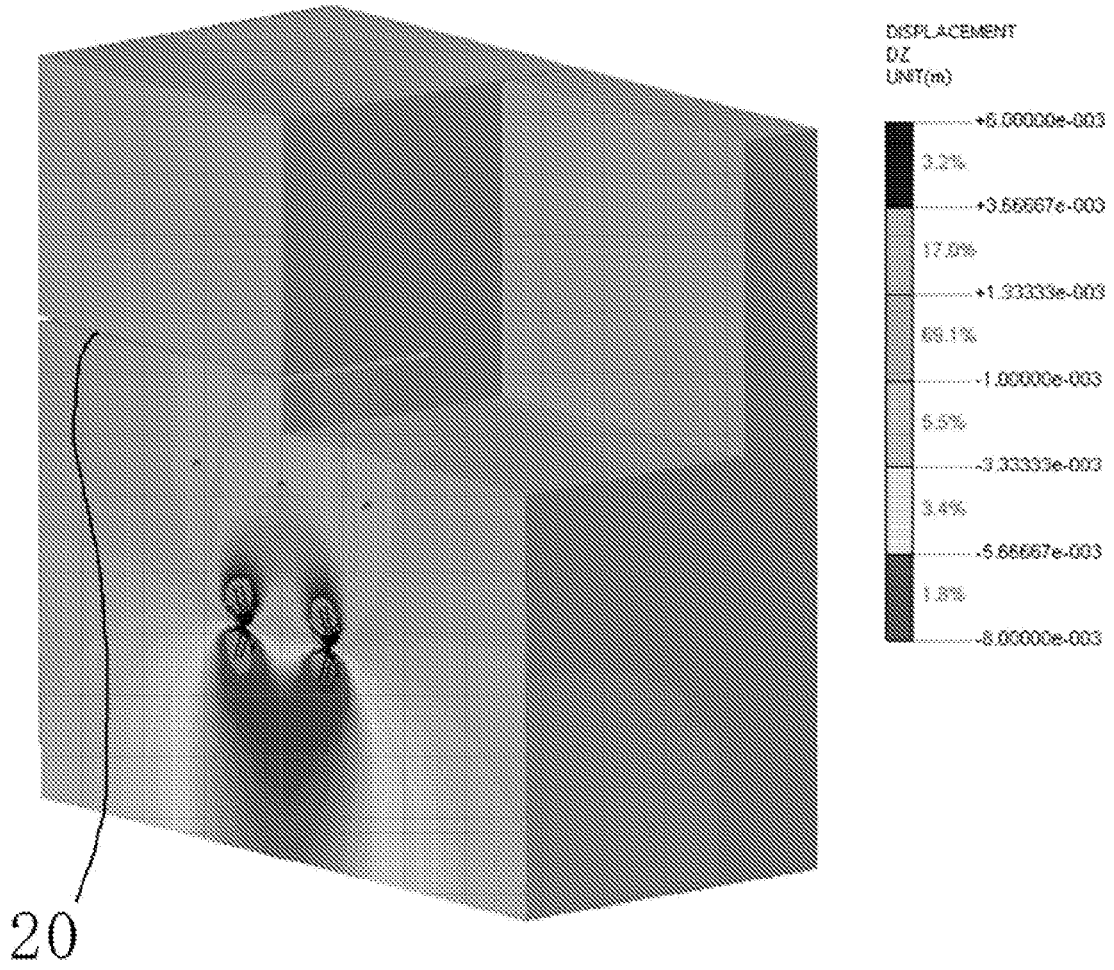

FIG. 15 is a view of simulated synthetic displacements of the contour hole 40 and the stopping hole 30 in XYZ directions, FIG. 16 is a view showing horizontal displacements of the contour hole 40 and the stopping hole 30, and FIG. 17 is a view of simulated displacements in the vertical direction. In these figures, (a) represents the case where the contour holes 40 and the stopping holes 30 are exploded without forming the free surface 20, (b) represents the case where the contour holes 40 and the stopping holes 30 are exploded after forming the free surface 20, and (c) represents the case where only the stopping holes 30 are exploded after forming the free surface 20. As shown in FIG. 15 to FIG. 17, the blast pressure is not propagated to the surrounding ground, surface, since the free surface 20 is formed. In addition, the difference in the blast pressure between (b) and (c) is not significant.

Figure 18:
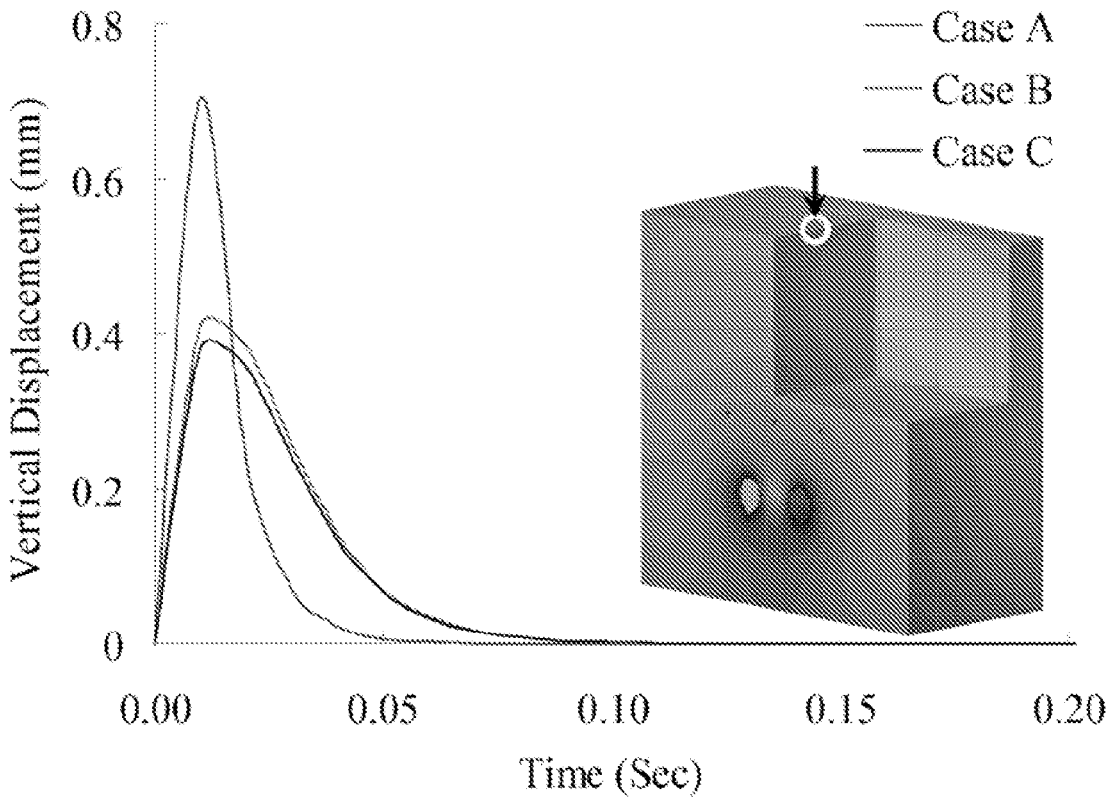
FIG. 18 is a view showing variations in vertical displacements depending on the time at a position 1 m above a contour hole.

FIG. 18 is a view showing variations in vertical displacements depending on the time at a position 1 m above the contour hole 40. Here, Case A indicates numerical values that represent the variation in the vertical displacement of a typical blast cross-section, Case B indicates numerical values that represent the variation in the vertical displacement of a blast cross-section when the free surface 20 was formed, and Case C indicates numerical values that represent the variation in the vertical displacement of a blast cross-section when the blasting was carried out using only the stopping holes 30 without considering the contour holes 40. Blast vibration is not greatly influenced by whether or not the contour holes 40 are present. This consequently leads to the reduced number of holes and the reduced amount of charges, thereby achieving the effect of the reduced construction cost.

Figure 19:
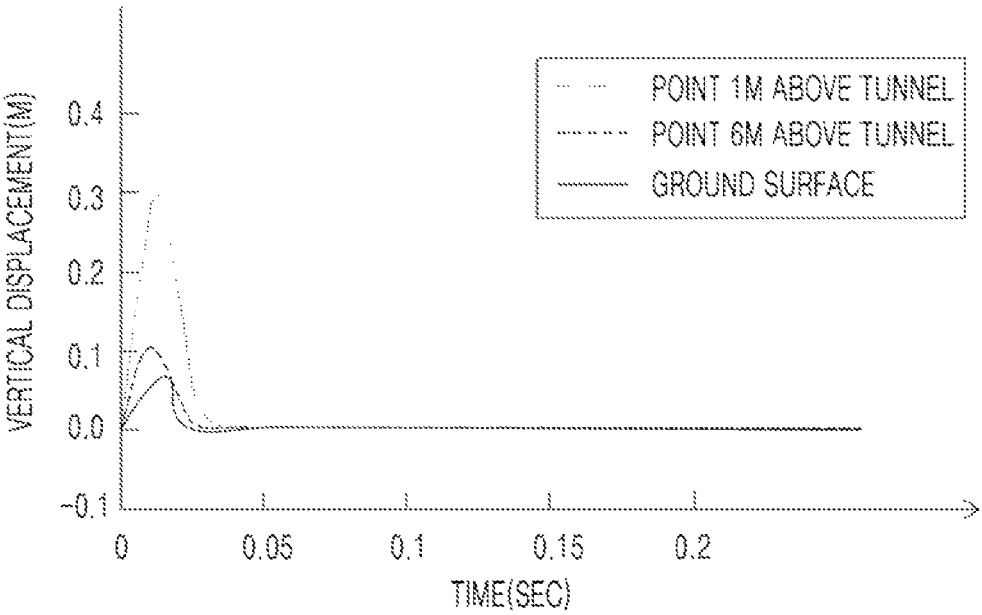
FIG. 19 and FIG. 20 are views showing variations in vertical displacements at a position above a blast point.
Figure 20:
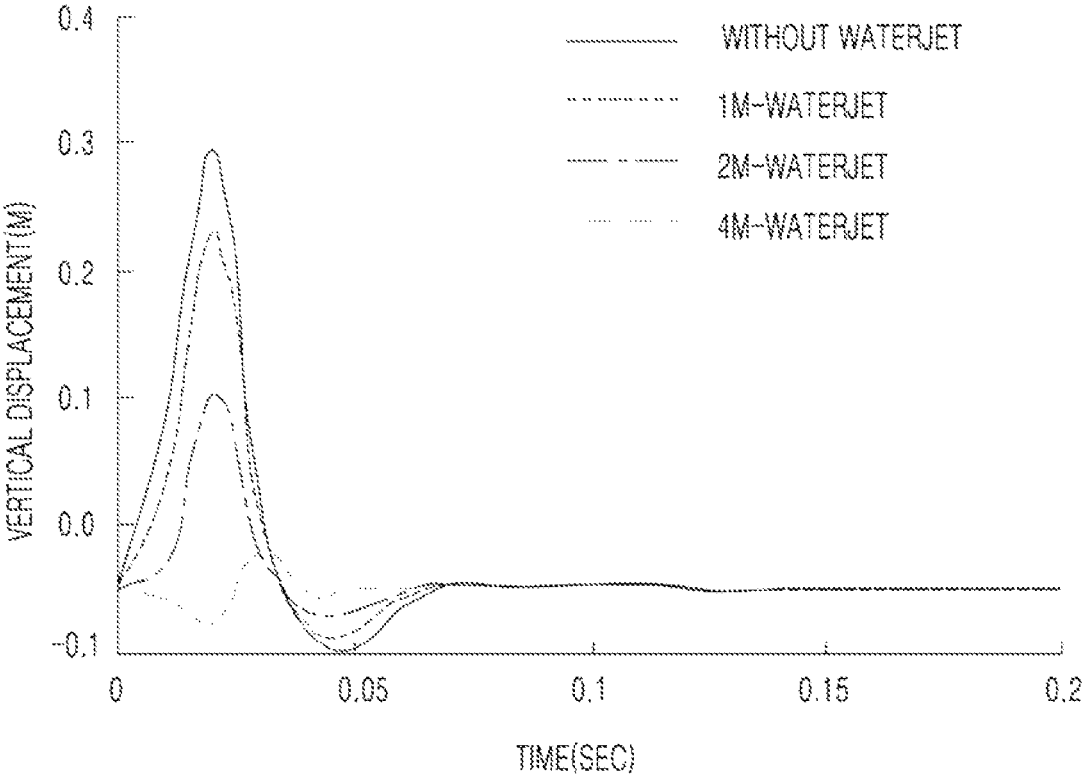

FIG. 19 and FIG. 20 are views showing variations in the vertical displacements at a position above a blast point. Here, the size of the blast vibration decreases the further the blast point is distanced from the top of the tunnel (see FIG. 19). It can be appreciated that the vibration amplitude is decreased the further it is distanced from the blast point. In addition, the arrival time of vibration waves also increases the further the blast point is distanced from the top of the tunnel (see FIG. 19).

FIG. 20 is a graph of simulated vertical variations at a ground surface above the tunnel blast point (a position distanced 20 m from the blast point), depending on whether the free surface is present and on the depth of the free surface. Referring to FIG. 20, it can be appreciated that blast vibration is decreased as the depth of the free surface 20 increases.

In the case where the free surface 20 is absent, the maximum vertical displacement of the ground surface (the ground surface distanced 20 m from the blast point) is about 0.07 (see FIG. 20). However, when the free surface 20 is formed, the maximum vertical displacement is decreased more than the case where the free surface 20 is not formed. In addition, as the depth of the free surface 20 is increased, the size of the maximum vertical displacement that occurs on the ground surface above the tunnel is gradually decreased. When the free surface 20 having a depth of 4 m is applied, the effect of reducing vibration is maximum 90% or more compared to the case where the free surface 20 is not applied.

FIG. 22 is simulation modeling for vertical displacements, in which tests were carried out by charging "Contour holes" and "Stopping holes" as in the following table and exploding the holes.

TABLE 5

| Comparison of components of charge | Stopping hole | Contour hole |
|---|---|---|
| Properties | Emulsion | Gurit |
| Density (g/cm$^3$) | 1.2 | 1.0 |
| Detonation velocity (ft/sec) | 16404 | 13123 |
| Diameter (mm) | 32 | 17 |

"a" is the case where the holes are formed in the free surface, at a width of 10 cm and a depth of 1 m, "b" is the case where blasting was carried out by forming 1 row of line drill holes without the free surface, and "c" is the case where blasting was carried out by forming two rows of line drill holes without the free surface.

Figure 23:
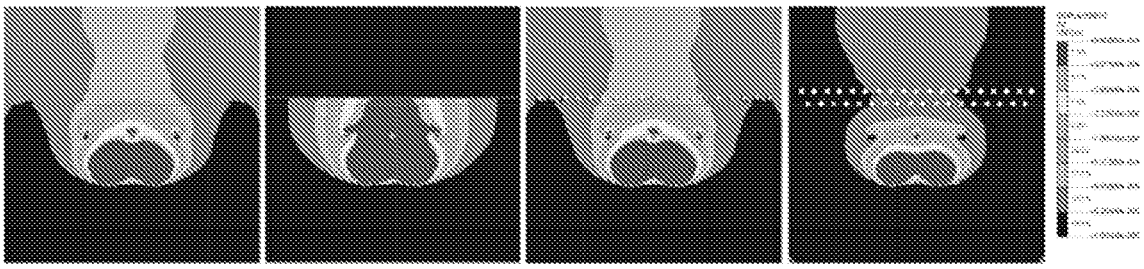
FIG. 23 is a view showing simulated values with respect to vertical displacements.
Figure 23:
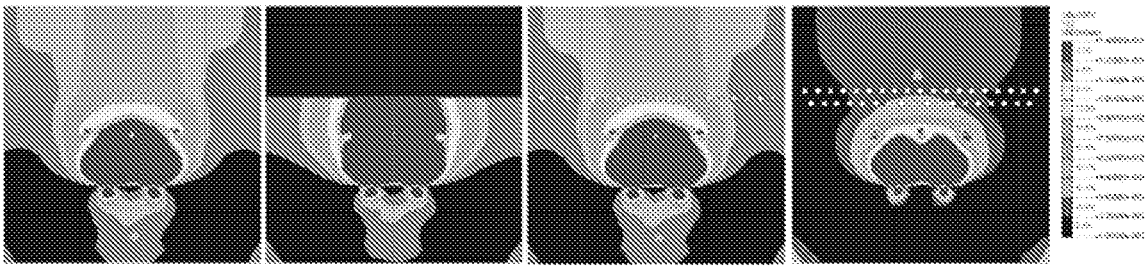

FIG. 23 snows measurements of vertical displacements that are caused by blasting. Although no significant differences occurred between the case where the line drill holes were formed and the case of typical tunnel blasting, it is appreciated that almost no vertical displacement occurred at the top when the free surface was formed.

Figure 24:
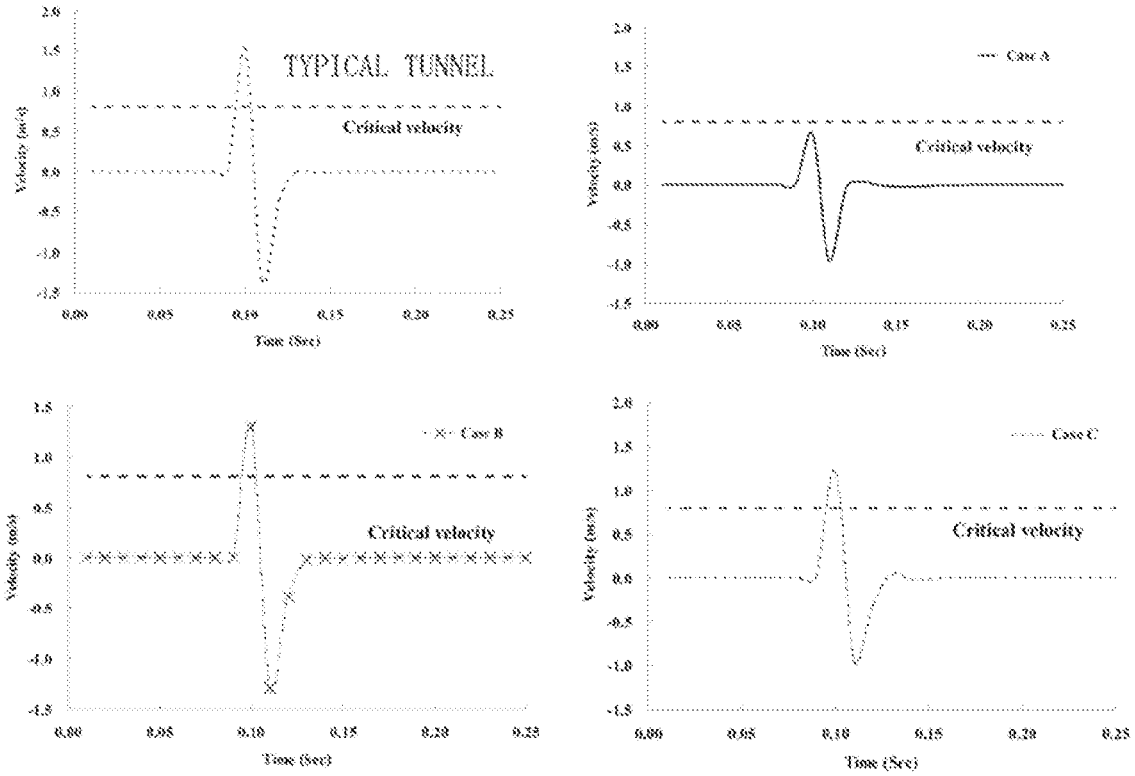
FIG. 24 is a graph showing measurements of maximum displacements with respect to vertical displacements.

FIG. 24 shows measurements of maximum vertical displacements. When the free surface was formed, the maximum displacement was measured to be about 0.6. It is generally known that a damage zone is formed when a maximum displacement of 0.7 or greater occurs.

Therefore, it can be appreciated that blast vibration can be effectively reduced when the free surface is formed according to the invention.

Although some exemplary embodiments of the present invention have been described with reference to the drawings for illustrative purposes, those skilled in the art to which the present invention relates will appreciate that various modifications and variations are possible, without departing from the scope and spirit of the invention as disclosed in the accompanying claims.

INDUSTRIAL APPLICABILITY

The present invention is applicable to tunnel excavation based on explosive blasting. In particular, it is expected that the invention is highly applicable to construction of urban subways and underground facilities for which high level reduction in the blast vibration is required.

MAJOR REFERENCE NUMERALS OF THE DRAWINGS

100: moving unit
200: articulated robot arm
300: water jet nozzle
310: depth sensor part
320: width sensor part
400: supply unit
500: control unit
600: water jet device
L: line
710: frame
720: moving means
730: water jet nozzle
732: measuring sensor
740: control device
750: rail
752: first rail
754: second rail

The invention claimed is:

1. An excavation system comprising:
a moving unit movable over an area that is to be blasted;
an articulated robot arm disposed on the moving unit;
a water jet nozzle mounted on a leading end of the robot arm;
a supply unit which supplies high pressure water to the water jet nozzle; and
a control unit which controls the moving unit, the robot arm and the water jet nozzle,
wherein the control unit controls the articulated robot arm so that the water jet nozzle follows a predetermined color line which is painted on a surface to be excavated.

2. The excavation system according to claim 1, wherein the supply unit supplies an abrasive along with high-pressure water.

3. The excavation system according to claim 1, wherein the predetermined color line forms a pattern on the surface to be excavated.

4. The excavation system according to claim 3, wherein the pattern on the surface to be excavated includes an arch-shaped pattern.

5. The excavation system according to claim 4, wherein the pattern on the surface to be excavated further includes a combined arch-shaped and zigzag pattern.

6. The excavation system according to claim 1, wherein
the water jet nozzle comprises a depth sensor part which measures a depth of the free surface that is crushed by the high-pressure water, and
the control unit controls the robot arm and the supply unit based on the depth that is crushed.

7. The excavation system according to claim 6, wherein
the water jet nozzle comprises a width sensor part which measures a width of the free surface that is crushed by the high-pressure water, and
the control unit controls the robot arm and the supply unit based on the width that is crushed.

8. The excavation system according to claim 6, wherein the depth sensor part is based on a laser.

9. The excavation system according to claim 7, wherein the width sensor part is based on a laser.

10. The excavation system according to claim 1, further comprising
a plurality of water jet nozzles; and
a plurality of articulated robot arms, wherein each of the plurality of water jet nozzles is mounted on a corresponding one of the plurality of articulated robot arms.

* * * * *